US007266339B2

(12) United States Patent
Fujiwara et al.

(10) Patent No.: US 7,266,339 B2
(45) Date of Patent: Sep. 4, 2007

(54) IMAGE-FORMING DEVICE

(75) Inventors: Yasushi Fujiwara, Nagoya (JP); Seiichi Senda, Nagoya (JP); Takehiro Masuda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 233 days.

(21) Appl. No.: 10/913,444

(22) Filed: Aug. 9, 2004

(65) Prior Publication Data

US 2005/0031386 A1 Feb. 10, 2005

(30) Foreign Application Priority Data

Aug. 7, 2003 (JP) ..... 2003-289064
Aug. 12, 2003 (JP) ..... 2003-292581

(51) Int. Cl.
*G03G 15/00* (2006.01)

(52) U.S. Cl. ..... 399/406; 399/328; 399/405

(58) Field of Classification Search ..... 399/405, 399/406, 328

See application file for complete search history.

(56) References Cited

U.S. PATENT DOCUMENTS

| | | | | |
|---|---|---|---|---|
| 4,300,757 | A * | 11/1981 | Koiso et al. | 271/207 |
| 6,227,536 | B1 * | 5/2001 | Bethke | 271/207 |
| 2002/0044810 | A1 * | 4/2002 | Sato et al. | 399/405 |
| 2005/0201794 | A1 * | 9/2005 | Suzuki | 399/405 |
| 2006/0067760 | A1 * | 3/2006 | Shimizu et al. | 399/377 |

FOREIGN PATENT DOCUMENTS

| | | |
|---|---|---|
| JP | 2001-146355 | 5/2001 |
| JP | 2001-255768 | 9/2001 |

* cited by examiner

*Primary Examiner*—David M. Gray
*Assistant Examiner*—Joseph S. Wong
(74) *Attorney, Agent, or Firm*—Oliff & Berridge, PLC

(57) ABSTRACT

In a fixing portion, a heating roller and a pressure roller are provided. An angle of separation θ (°), the temperature $T_{HR}$ (° C.) of the surface of the heating roller, the diameter $D_{PR}$ (mm) of the pressure roller, and the width $W_{NIP}$ (mm) of a nip part are set to satisfy the following inequality: $114 \leqq 0.55\ T_{HR} - 2.36\theta - 1.59\ D_{PR} + 8.62\ W_{NIP} \leqq 144$.

26 Claims, 17 Drawing Sheets

IMAGE-FORMING DEVICE

BACKGROUND OF THE INVENTION

1. Field of the Invention

The present invention relates to an image-forming device.

2. Description of Related Art

A laser beam printer disclosed in Japanese unexamined patent application publication No. 2001-146355 forms images using an electrophotographic system. The electrophotographic system forms images by first applying a uniform charge over the surface of a photosensitive member, and exposing the photosensitive member to a laser beam irradiated by an optical mechanism, such as a scanner. The surface of the photosensitive member is selectively exposed based on image data to form an electrostatic latent image. This latent image is developed into a toner image. Subsequently, the toner image borne on an image-bearing member (the photosensitive member or an intermediate transfer member) is transferred onto a recording paper. The transferred image is fixed onto the recording paper as the recording paper passes through a nip part formed between a heating roller and a pressure roller in a fixing unit.

An image-forming device disclosed in Japanese unexamined patent application publication No. 2001-255768 focuses on the relationship between the softening point of toner and an angle of separation. The angle of separation is defined within a plane orthogonal to the central axis of the heating roller. The angle of separation is defined as an angle between the direction in which the recording paper is discharged from a downstream end of the nip part and a tangent to the heating roller at the downstream end in the nip part. This image-forming device sets the angle of separation and the softening point of the toner to satisfy a predetermined relationship in order to minimize the amount of curl generated in the recording paper.

SUMMARY OF THE INVENTION

Recording paper still curls even when the angle of separation and the toner softening point have been set to satisfy the predetermined relationship.

In view of the foregoing, it is an object of the present invention to provide an improved image-forming device that is capable of effectively minimizing the amount of curl generated in recording paper during a printing process.

In order to attain the above and other objects, the present invention provides an image-forming device including: an image-forming portion; and a fixing portion. The image-forming portion forms a visible image on an A4-size recording paper by using developer, the recording paper having four sides, the four sides including a pair of opposite first sides and a pair of opposite second sides that are longer than the first sides. The fixing portion includes: a heating roller; and a pressure roller. The heating roller has a central axis and a rigid peripheral surface around the central axis, the peripheral surface being heated to a temperature $T_{HR}$ (° C.). The pressure roller has a central axis and a resilient layer around the central axis, the central axis of the pressure roller being parallel to the central axis of the heating roller. The pressure roller has a diameter $D_{PR}$ (mm). The pressure roller is pressed against the heating roller to allow the resilient layer to be compressed by the rigid surface of the heating roller, thereby causing the resilient layer of the pressure roller to deform and follow the shape of the surface of the heating roller. A nip part is defined as an area of contact between the heating roller and the pressure roller. The heating roller and the pressure roller rotate to convey the recording paper in a recording paper conveying direction through the nip part. The nip part has an upstream end and a downstream end in the recording paper conveying direction. The heating roller and the pressure roller convey the recording paper through the nip part from the upstream end to the downstream end with a leading edge of the recording paper being one of the first sides, thereby causing the visible image to be fixed on the recording paper. The heating roller and the pressure roller discharge the recording paper fixed with the visible image from the downstream end of the nip part in a discharging direction. The heating roller has a width $W_{NIP}$ (mm) at the nip part between the upstream end and the downstream end. An angle of separation θ (°) is defined within a plane orthogonal to the central axis of the heating roller and is formed between the discharging direction and a tangent to the heating roller at the downstream end of the nip part. The temperature $T_{HR}$ (° C.), the angle of separation θ (°), the diameter $D_{PR}$ (mm), and the width $W_{NIP}$ (mm) satisfying the following inequality:

$$114 \leqq 0.55T_{HR} - 2.36\theta - 1.59D_{PR} + 8.62W_{NIP} \leqq 144.$$

According to another aspect, the present invention provides an image-forming device including: a casing; an image-forming portion; a discharge roller; and a stacking portion. The casing has a top surface. The image-forming portion is provided inside the casing and forms an image on the recording paper. The discharge roller discharges, in a discharge-roller discharging direction, the recording paper which has been formed with an image by the image-forming portion. The stacking portion has a stacking surface that faces upwardly and that receives thereon sheets of recording paper discharged by the discharge roller. The stacking surface has a first end that is positioned below the discharge roller and a second end that is downstream of the first end in the discharge-roller discharging direction. The stacking surface is connected to the top surface via the second end. The top surface extends in the discharge-roller discharging direction from the second end of the stacking surface. The stacking portion has a crest that protrudes upwardly at a position between the first end and the second end. The crest protrudes upwardly. A first part of the stacking surface defined between the first end and the crest is slanted upwardly toward the crest, an angle within a range of greater than or equal to 20 degrees and smaller than or equal to 55 degrees being formed between the first part and a horizontal direction.

BRIEF DESCRIPTION OF THE DRAWINGS

The above and other objects, features and advantages of the invention will become more apparent from reading the following description of the preferred embodiments taken in connection with the accompanying drawings in which:

FIG. 4(*b*) is an explanatory diagram showing sheets of discharged printed recording paper with a tubular curl;

FIG. 4(*c*) is an explanatory diagram showing sheets of discharged printed recording paper with a forward curl;

FIG. 7(*b*) illustrates how a replaceable adaptor is mounted in a discharge tray in the laser printer of FIG. 7(*b*);

FIG. 7(*c*) illustrates the angles formed by rear and front surface parts of the replaceable adaptor and a front part of a top surface of a main casing of the laser printer relative to a horizontal direction;

FIG. 8(*b*) is a side cross-sectional view showing a conceivable laser printer;

FIG. 10(*b*) is a rear view of a paper-holding member mounted in the laser printer of FIG. 10(*a*) and viewed from the rear side thereof as indicated by an arrow H;

DETAILED DESCRIPTION OF THE PREFERRED EMBODIMENTS

Figure 1:
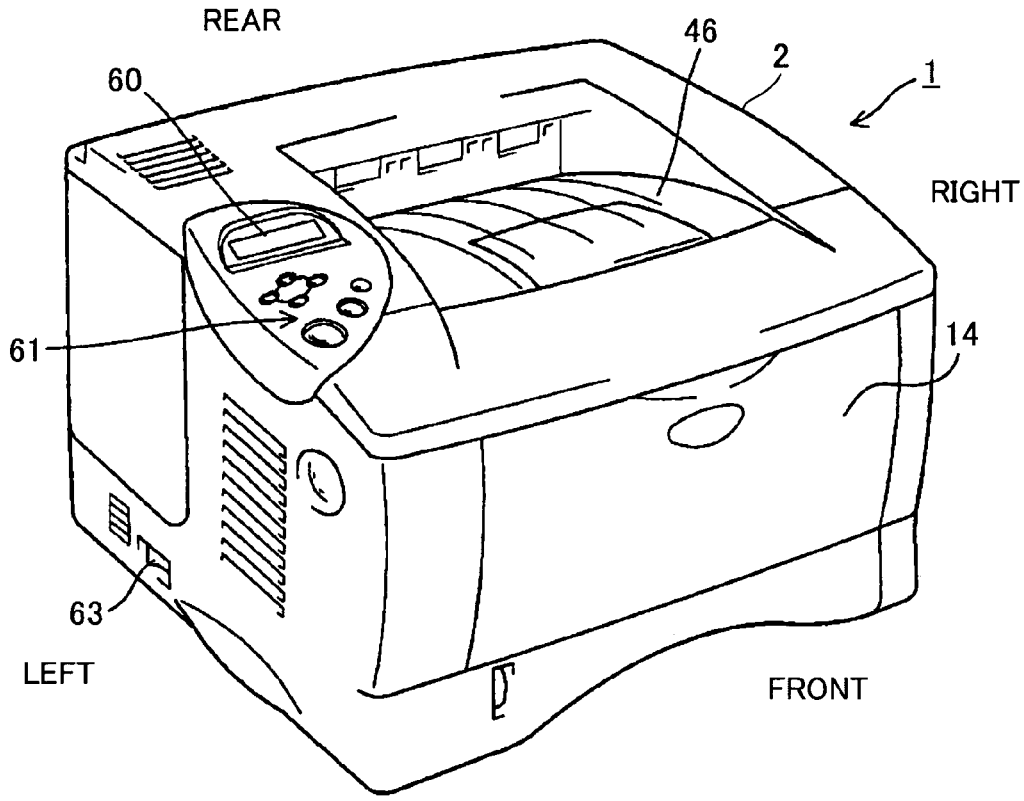
FIG. 1 is a perspective view showing the general structure of a laser printer according to a first embodiment of the present invention.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

First Embodiment

Next, a laser printer 1 according to a first preferred embodiment will be described while referring to FIGS. 1-6.

Figure 2:
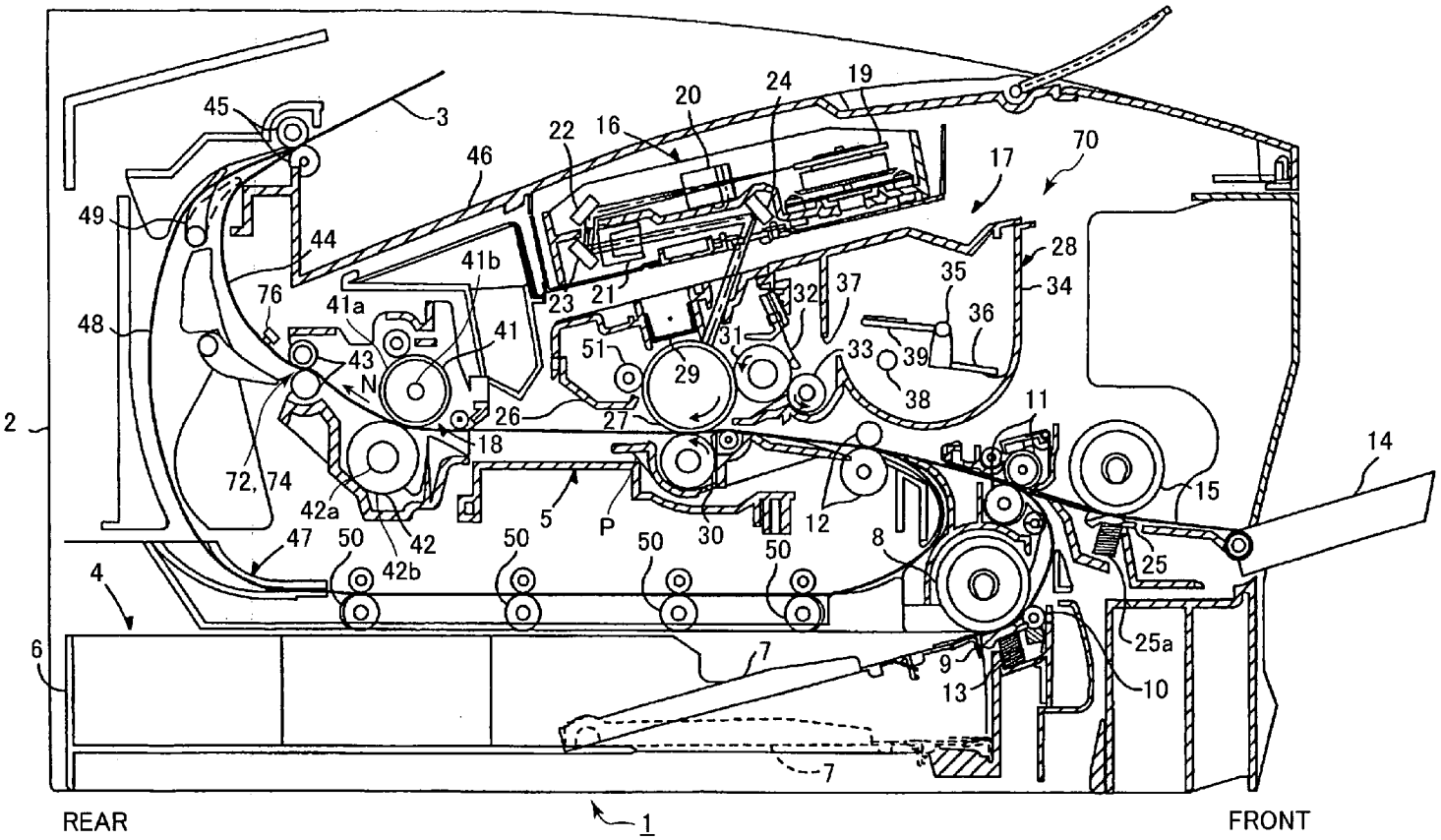
FIG. 2 is a side cross-sectional view showing the construction of the laser printer according to the first embodiment.
Figure 3:
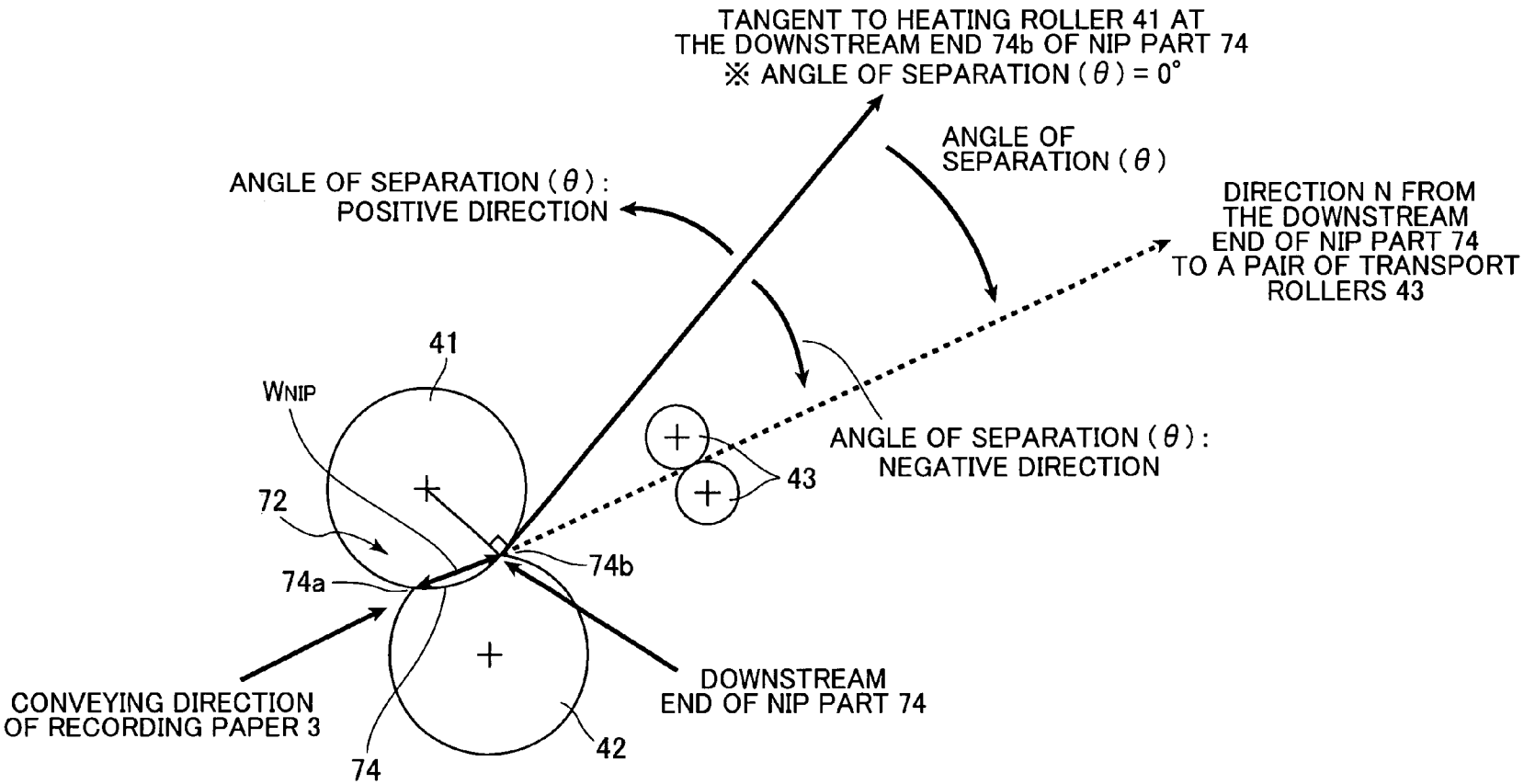
FIG. 3 is an explanatory diagram showing a fixing unit in the laser printer according to the first embodiment.
Figure 4A:
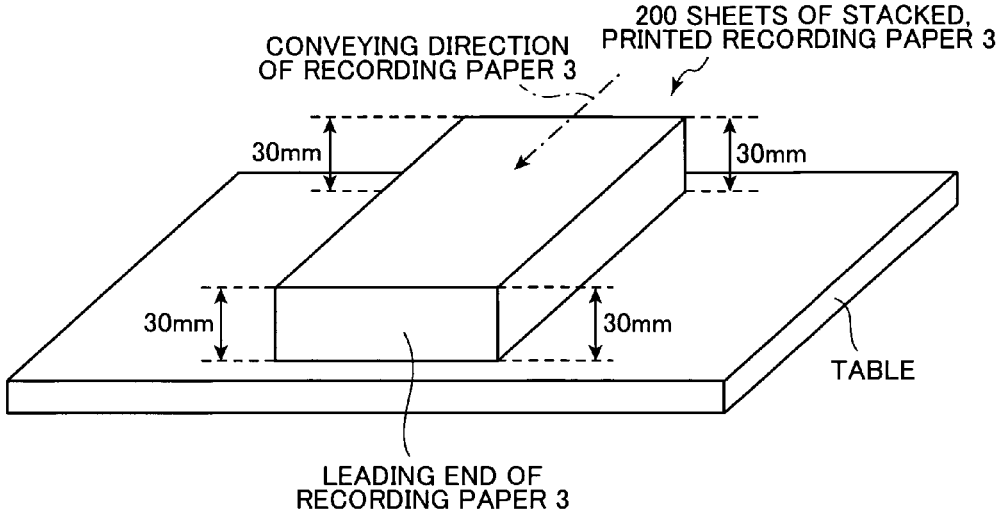
FIG. 4(*a*) is an explanatory diagram showing sheets of discharged printed recording paper that are not curled.
Figure 4B:
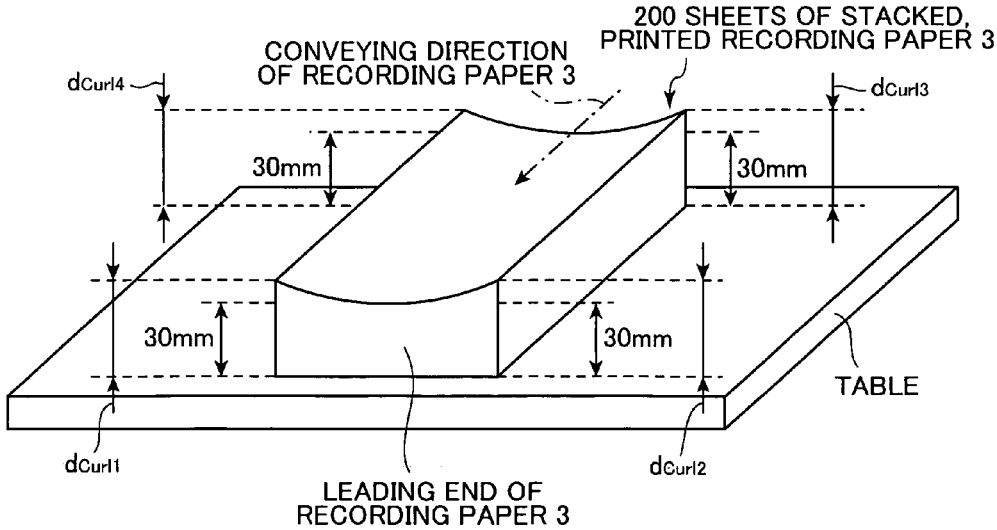
Figure 4C:
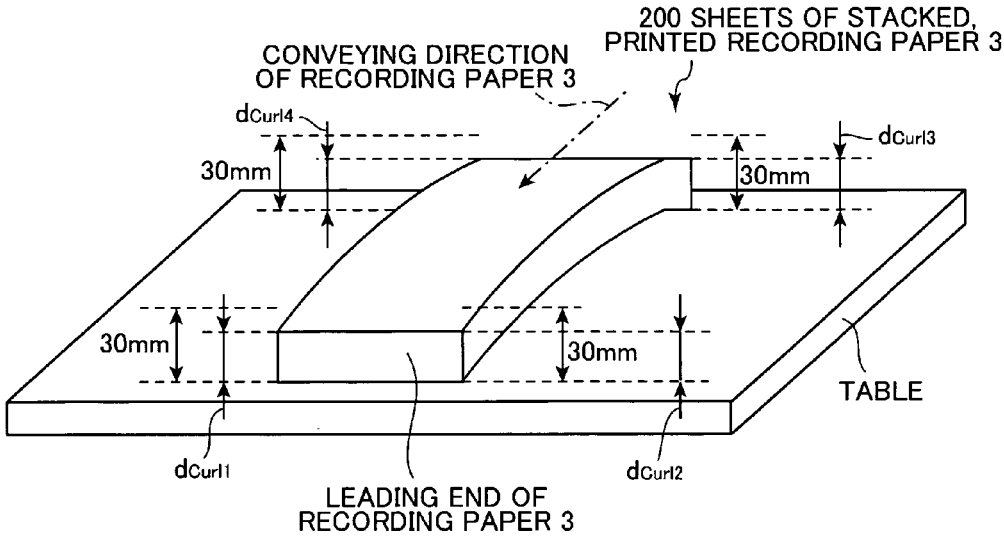

FIG. 1 is a perspective view showing the general structure of the laser printer 1. FIG. 2 is a side cross-sectional view showing the construction of the laser printer 1. FIG. 3 is an explanatory diagram showing a fixing unit of the laser printer according to the first embodiment. FIG. 4(*a*) is an explanatory diagram showing discharged sheets of recording paper that are not curled. FIG. 4(*b*) is an explanatory diagram showing discharged sheets of recording paper with a tubular curl. FIG. 4(*c*) is an explanatory diagram showing discharged sheets of recording paper with a forward curl.

The laser printer 1 is for printing on an A4 size sheet of recording paper. The A4 size sheet of recording paper has four sides, which include a pair of opposite sides with a length of 210 mm (two shorter sides) and another pair of opposite sides with a length of 298 mm (two longer sides). The laser printer 1 prints on the A4 size sheet, while conveying the sheet in a sheet conveying direction with a leading edge of the sheet being one of the two shorter sides and with a trailing edge of the sheet being the other of the two shorter sides.

As shown in FIG. 1, the laser printer 1 has a main casing 2. The main casing 2 is attached with a multi-purpose tray 14. The side of the laser printer 1, on which the multi-purpose tray 14 is provided, will be referred to as "a front side" of the laser printer 1. The other side of the laser printer 1 opposite to the front side will be referred to as "a rear side" of the laser printer 1. Right and left sides of the laser printer 1 viewed from the front side will be referred to as "right side" and "left side" of the laser printer 1.

The laser printer 1 has: a paper supply tray 6 (FIG. 2); a discharge tray 46; a display portion 60; an operation portion 61; and a power switch 63. The paper supply tray 6 is detachably mounted to a bottom portion of the main casing 2. The paper supply tray 6 is for accommodating a stack of sheets of recording paper 3 therein. The discharge tray 46 is for receiving a stack of sheets of recording paper 3, onto which images have been printed by the laser printer 1. The sheets of recording paper 3 are oriented on the discharge tray 46, with their leading edges (one shorter sides) facing forwardly. The display portion 60 is for indicating the status of the laser printer 1. The operation portion 61 is for allowing a user to perform various operation settings on the laser printer 1. The power switch 63 is a main switch of the laser printer 1.

As shown in FIG. 2, the laser printer 1 includes: a feeder section 4 and an image forming section 70. The feeder section 4 and the image forming section 70 are housed in the main casing 2. The feeder section 4 supplies sheets 3 to the image forming section 70. The image forming section 70 forms desired images on the supplied sheets 3.

The feeder section 4 includes: the paper supply tray 6, a paper pressing plate 7, a sheet supply roller 8, a separating pad 9, paper dust removing rollers 10 and 11, and registration rollers 12. The paper pressing plate 7 is disposed inside the paper supply tray 6. The sheet supply roller 8 and the separating pad 9 are disposed above one end of the paper supply tray 6. The paper dust removing roller 10 and paper dust removing rollers 11 are disposed downstream of the sheet supply roller 8 in the conveying direction of the paper 3. The registration rollers 12 are disposed downstream of the paper dust removing roller 10 and the paper dust removing rollers 11 in the conveying direction of the paper 3.

The sheet pressing plate 7 is pivotably supported at its end furthest from the sheet supply roller 8 so that the end of the sheet pressing plate 7 that is nearest the sheet supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring.

The sheet supply roller 8 and the sheet supply pad 9 are disposed in confrontation with each other. A spring 13 is provided beneath the sheet supply pad 9 for pressing the sheet supply pad 9 toward the sheet supply roller 8. Urging force of the spring under the sheet pressing plate 7 presses the uppermost sheet 3 on the sheet pressing plate 7 toward the sheet supply roller 8. According to rotation of the sheet supply roller 8, the uppermost sheet 3 is sandwiched between the sheet supply roller 8 and the separation pad 13. Thereafter, one sheet 3 at a time is separated from the stack and supplied to the paper dust removing rollers 10, 11.

The paper dust removing rollers 10, 11 remove paper dust from the supplied sheet 3 and further convey the sheet 3 to the registration rollers 12. The pair of registration rollers 12 performs a predetermined registration operation on the supplied sheet 3, and transport the sheet 3 to the image formation section 70.

The feeder section 4 further includes a multipurpose sheet supply mechanism. The multipurpose sheet supply mechanism includes: the multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 25*a* provided beneath the multipurpose sheet supply pad 25 presses the multipurpose sheet supply pad 25 up toward the multipurpose sheet supply roller 15.

Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation section 70.

The image forming section 70 includes: a scanner unit 16, a process unit 17, and a fixing section 18.

The scanner unit 16 is provided at the upper section of the casing 2 and is provided with a laser emitting section (not shown), a polygon mirror 19, lenses 20, 21, and reflection mirrors 22, 23, 24. The laser emitting section emits a laser beam. The polygon mirror 19 is driven to rotate. As indicated by a single-dot chain line in FIG. 2, the laser beam passes through or is reflected by the polygon mirror 19, the lens 20, the reflection mirrors 22 and 23, the lens 21, and the reflection mirror 24 in this order so as to irradiate, in a high speed scanning operation, the surface of a photosensitive drum 27 of the process unit 17.

The process unit 17 is disposed below the scanner unit 16. The process unit 17 includes a drum cartridge 26. The drum cartridge 26 can be attached to and detached from the main casing 2. The drum cartridge 26 houses therein the photosensitive drum 27, a development cartridge 28, a scorotron charge unit 29, a transfer roller 30 and a cleaning roller 51.

The development cartridge 28 is detachable from the drum cartridge 26 and is provided with a developing roller 31, a layer thickness regulating blade 32, a supply roller 33, and a toner box 34. The toner box 34 is filled with toner of styrene acrylic co-polymer. A rotation shaft 35 is disposed in the center of the toner box 34. An agitator 36 is supported on the rotation shaft 35. The agitator 36 rotates and agitates the toner in the toner box 34 and discharges the toner through a toner supply opening 37 that is opened through the side wall of the toner box 34. A window 38 for detecting remaining toner is provided in each of two opposing end walls of the toner box 34. A cleaner 39 for cleaning the windows 38 is supported on the rotation shaft 35.

The supply roller 33 is located on the side of the toner supply opening 37. The developing roller 31 is located confronting the supply roller 33. The supply roller 33 and the developing roller 31 are rotatable in the counterclockwise direction. The supply roller 33 and the developing roller 31 are disposed in abutment contact with each other so that both are compressed to a certain extent.

The supply roller 33 includes a metal roller shaft covered with a roller formed from an electrically conductive sponge material.

The developer roller 31 includes a metal roller shaft and a roller portion covered thereon. The roller portion is made from a conductive rubber material having no magnetic property. In more specific terms, the roller portion of the developing roller 31 is made from conductive silicone rubber or urethane rubber including, for example, carbon particles. The surface of the roller portion is covered with a coating layer of silicone rubber or urethane rubber that contains fluorine. The developing roller 31 is applied with a developing bias.

The layer thickness regulating blade 32 is disposed near the developing roller 31. The layer thickness regulating blade 32 includes a blade made from a metal leaf spring, and has a pressing member, that is provided on a free end of the blade. The pressing member has a semi-circular shape when viewed in cross section. The pressing member is formed from silicone rubber with electrically insulating properties. The layer thickness regulating blade 32 is supported by the developing cartridge 28 at a location near the developing roller 31. The resilient force of the blade presses the pressing member against the surface of the developing roller 31.

The rotation of the supply roller 33 supplies the developing roller 31 with toner that has been discharged through the toner supply opening 37. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member of the layer thickness regulating blade 32. This further triboelectrically charges the toner, and reduces thickness of the toner on the surface of the developing roller 31 down to a thin layer of uniform thickness.

The photosensitive drum 27 is disposed to the side of and in confrontation with the developing roller 31. The photosensitive drum 27 is rotatable in the clockwise direction as indicated by an arrow. The photosensitive drum 27 includes a drum-shaped member and a surface layer. The surface layer is formed from a photosensitive layer that is made from polycarbonate and that has a positively charging nature. The photosensitive drum 27 rotates in the clockwise direction according to the power supplied from a main motor (not shown in the drawings).

The scorotoron charge unit 29 is disposed above the photosensitive drum 27 and is spaced away from the photosensitive drum 27 by a predetermined space so as to avoid direct contact with the photosensitive drum 27. The scorotron charge unit 29 is a positive-charge scorotron type charge unit for generating a corona discharge from a charge wire made from, for example, tungsten. The scorotoron charge unit 29 forms a blanket of positive-polarity charge on the surface of the photosensitive drum 27.

As the photosensitive drum 27 rotates, the scorotoron charge unit 29 first forms a blanket of positive charge on the surface of the photosensitive drum 27, and then the surface of the photosensitive drum 27 is exposed to high speed scan of the laser beam from the scanner unit 16. The electric potential of the positively charged surface of the photosensitive drum 27 drops at positions exposed to the laser beam. As a result, an electrostatic latent image is formed on the photosensitive drum 27 based on desired image data used to drive the laser beam.

Next, an inverse developing process is performed. That is, as the developing roller 31 rotates, the positively-charged toner borne on the surface of the developing roller 31 is brought into contact with the photosensitive drum 27. Because of the developing bias voltage applied to the developing roller 31, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

The transfer roller 30 is rotatably supported at a position below and in confrontation with the photosensitive drum 27. The transfer roller 30 is rotatable in the counterclockwise direction as indicated by an arrow. The transfer roller 30 includes a metal roller shaft and a roller portion covering the shaft and made from ionic conductive rubber material. At times of toner image transfer, the transfer roller 30 is applied with a predetermined transfer bias. The visible toner image borne on the surface of the photosensitive drum 27 is transferred to a sheet 3 according to the transfer bias applied to the transfer roller 30 as the sheet 3 passes between the photosensitive drum 27 and the transfer roller 30.

The fixing unit 18 is disposed to the side and downstream of the process unit 17 in the sheet conveying direction.

The fixing unit 18 includes: a heating roller 41; a pressure roller 42 that applies pressure to the heating roller 41; and a pair of transport rollers 43 disposed downstream of the heating roller 41 and the pressure roller 42.

More specifically, the heating roller 41 includes: a metal hollow tube 41*a*, whose peripheral surface is rigid; and a halogen lamp 41*b* enclosed in the metal hollow tube for heating the roller 41. The pressure roller 42 has a roller shaft 42*a*, whose peripheral surface is covered with a resilient layer 42*b*.

As shown in FIG. 3, the heating roller 41 and the pressure roller 42 are disposed with their central axes extending parallel to each other. The central axis of the pressure roller 42 is disposed relative to the central axis of the heating roller 41 with a distance therebetween being smaller than the sum of the radii of the pressure roller 42 and the heating roller 41. Accordingly, the pressure roller 52 is pressed against the heating roller 41 at its pressed part 72 by a spring or other pressing device (not shown in the drawings.) The resilient layer 42*b* on the surface of the pressure roller 42 is compressed at the pressed part 72, and part of the surface of the pressure roller 42 deforms in order to conform to the rigid surface of the heating roller 41. This deformed part is called a nip part 74.

The heating roller 41 and the pressure roller 42 rotate to convey the recording paper 3 in a recording paper conveying direction through the nip part 74 from its upstream end 74*a* toward its downstream end 74*b* in the recording paper conveying direction, with a leading edge of the recording paper 3 being one of the two shorter sides. When the recording paper 3 passes between the heating roller 41 and the pressure roller 42, toner which has been transferred onto the recording paper 3 in the process unit 17 is fixed to the recording paper 3 by heat at the nip part 74. The heating roller 41 and the pressure roller 42 discharge the recording paper 3, which is now fixed with the visible image, from the downstream end 74*b* in a discharging direction N toward the transport rollers 43.

It is noted that the pressure roller 42 has a diameter $D_{PR}$ (mm). More specifically, the outer peripheral surface of the resilient layer 42*b* has a circular cross-section with its diameter being $D_{PR}$ (mm). The angle of separation θ (°) is defined within a plane orthogonal to the central axis of the heating roller 41 (plane of sheet of FIG. 3). The angle of separation θ (°) is formed between the discharging direction N, in which the recording paper 3 is discharged from the downstream end 74*b* of the nip part 74 to the transport rollers 43, and a tangent to the heating roller 41 at the downstream end 74*b* of the nip part 74. The nip width $W_{NIP}$ (mm) is defined as a width of the nip part 74 between the upstream end 74*a* and the downstream end 74*b*. In other words, the nip width $W_{NIP}$ (mm) is defined as a width of the heating roller 41 at the nip part 74 in a direction perpendicular to the central axis of the heating roller 41.

As shown in FIG. 2, the transport rollers 43 transport or convey the recording paper 3 along a discharge path 44. A paper sensor 76 for detecting the presence of the recording paper 3 conveyed from the fixing unit 18 is disposed adjacent to the transport rollers 43. The paper sensor 76 outputs a signal indicative of the result of detection. The recording paper 3 is conveyed along the discharge path 44 to discharge rollers 45 and is discharged by the discharge rollers 45 onto the discharge tray 46.

It is noted that the sheets of recording paper 3 curl when discharged onto the discharge tray 46. The different types of curl include a "tubular curl" in which the lengthwise sides of the recording paper 3 in the conveying direction curl upward to form a tubular shape (see FIG. 4(*b*)); and a "forward curl" in which the leading portion of the recording paper 3 in the conveying direction curls downward (see FIG. 4(*c*)). In this example, the recording paper 3 is conveyed with its leading edge being one of the shorter sides. Accordingly, the longer sides of the A4-size recording paper 3 curl upward to form a tubular shape (see FIG. 4(*b*)), while the leading shorter side of the A4-size recording paper 3 curls downward to form a forward curl.

The laser printer 1 is further provided with an inverting transport section 47 for inverting sheets 3 that have been printed on once and for returning the sheets 3 to the image forming section 70 so that images can be formed on both sides of the sheets 3. The inverting transport section 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse after being temporarily rotated in forward when sheets are to be inverted.

The inversion transport rollers 50 are disposed below the image forming section 70. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 2. The orientation shown in solid line in FIG. 2 is for transporting sheets 3 that have one side printed to the sheet-discharge rollers 45. The orientation shown in broken line in FIG. 2 is for transporting sheets from the sheet-discharge rollers 45 into the inversion transport path 48, rather than back into the sheet-discharge path 44.

The inversion transport rollers 50 are aligned horizontally at positions above the sheet supply tray 6. One pair of inversion transport rollers 50 that is farthest upstream is disposed near the rear end of the inversion transport path 48. Another pair of inversion transport rollers 50 that is located farthest downstream is disposed below the registration rollers 12.

Figure 5:
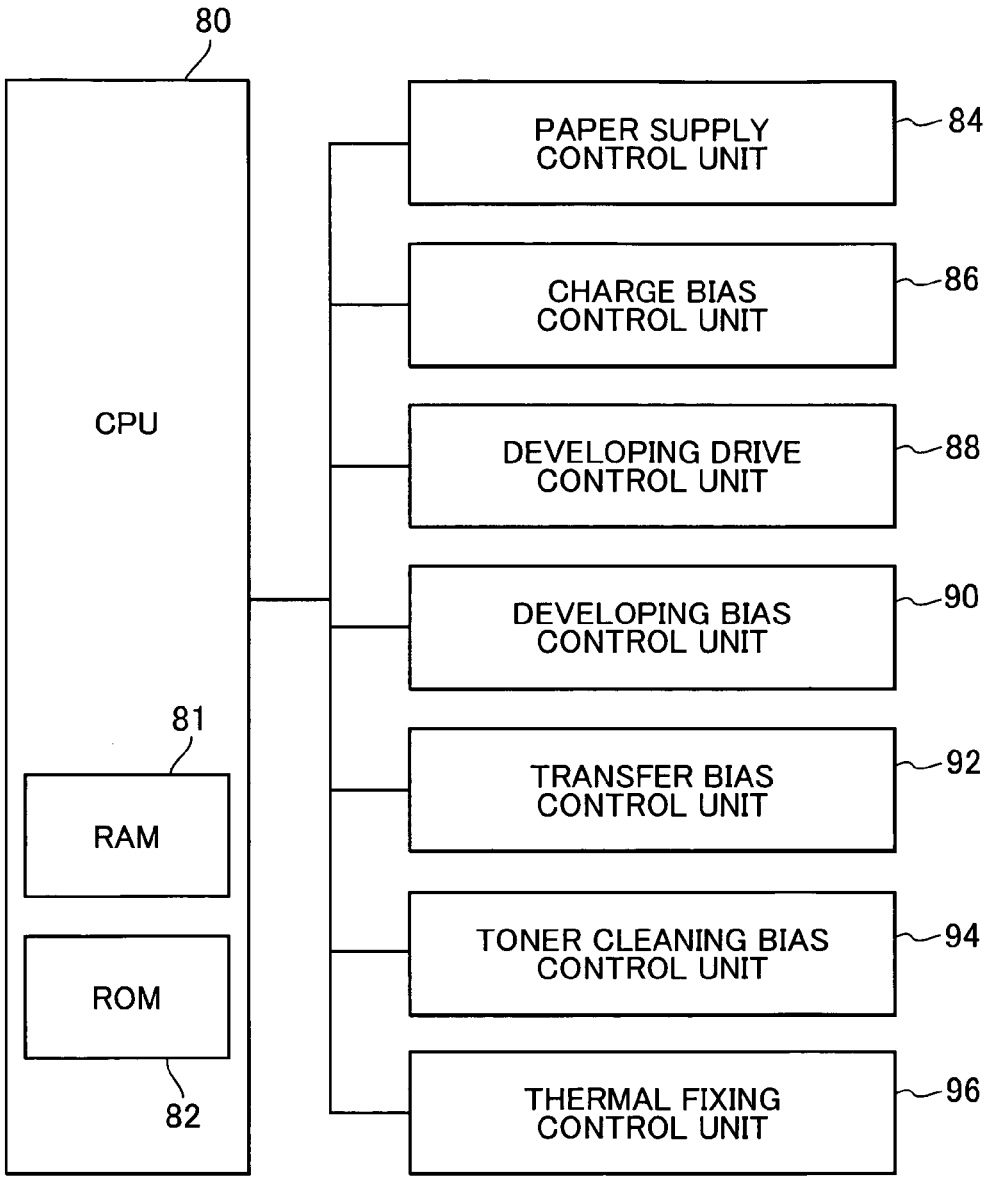
FIG. 5 is a block diagram showing a control system used in the laser printer according to the first embodiment.

Next, a control system in the laser printer 1 will be described with reference to the block diagram of FIG. 5. In the control system shown in FIG. 5, a CPU 80 is connected to each of a paper supply control unit 84, a charge bias control unit 86, a developing drive control unit 88, a developing bias control unit 90, a transfer bias control unit 92, a toner cleaning bias control unit 94, and a thermal fixing control unit 96.

The CPU 80 includes a RAM 81 and a ROM 82. The CPU 80 functions to execute various control processes. The RAM 81 temporarily stores numerical data for controlling the units 84-96. The ROM 82 stores various control programs, including a main control program, for controlling the various units 84-96.

In the laser printer 1 according the preferred embodiment, the CPU 80 executes the main control program in order to control the various control units 84-96 to execute processes for paper supply control, charge bias control, developing drive control, developing bias control, transfer bias control, toner cleaning bias control, and thermal fixing control.

There are various factors that affect the generation of curl in recording paper. The factors include: the angle of separation θ (°), the temperature $T_{HR}$ (fixing control temperature) (° C.) of the surface of the heating roller 41, the diameter $D_{PR}$ (mm) of the pressure roller 42, and the width $W_{NIP}$ (mm) of the nip part 74.

It is preferable that the angle of separation θ (°), the temperature $T_{HR}$ (fixing control temperature) (° C.) of the surface of the heating roller 41, the diameter $D_{PR}$ (mm) of the pressure roller 42, and the width $W_{NIP}$ (mm) of the nip part 74 are set to satisfy the following inequality:

$$114 \leqq 0.55T_{HR} - 2.36\theta - 1.59D_{PR} + 8.62W_{NIP} \leqq 144.$$

It is possible to decrease the amount of curl produced in recording paper.

It is more preferable that the values θ (°), $T_{HR}$ (° C.), $D_{PR}$ (mm), and $W_{NIP}$ (mm) are set to satisfy the following inequality:

$$119 \leqq 0.55T_{HR} - 2.36\theta - 1.59D_{PR} + 8.62W_{NIP} \leqq 134.$$

It is possible to decrease the amount of curl produced in recording paper and further to decrease variations in the amount of curl generated in recording paper.

An experiment described below was executed, after setting the factors θ (°), $T_{HR}$ (° C.), $D_{PR}$ (mm), and $W_{NIP}$ (mm) individually in the ranges described below: Range for the fixing control temperature $T_{HR}$ (° C.): 155° C. to 225° C.
Range for the angle of separation θ (°): −10.3° to 1.7°
Range for the diameter $D_{PR}$ (mm): 25 mm to 35 mm
Range for the nip width $W_{NIP}$ (mm): 6.3 mm to 7.8 mm After the parameters θ (°), $T_{HR}$ (° C.), $D_{PR}$ (mm), and $W_{NIP}$ (mm) were set to one combination of values within the above-described range, 200 sheets of the recording paper 3 were printed consecutively. Each sheet was printed on its one side with a coverage (printing area ratio) of 4%. The recording paper 3 used was DataCopy (trademark), manufactured by Modo (A4-size, 80 g recording paper). The temperature of the experiment site was 23° C. with 60% humidity.

After consecutively printing 200 sheets of the recording paper 3, the 200 sheets of the printed recording paper 3 were placed on a table as shown in FIG. 4(*a*), FIG. 4(*b*), or FIG. 4(*c*). If no curl was generated, the stacked sheets were placed as shown in FIG. 4(*a*). If tubular curl was generated, the stacked sheets were placed as shown in FIG. 4(*b*). If forward curl was generated, the stacked sheets were placed as shown in FIG. 4(*b*).

Curl was determined as the height of each corner of the stacked sheets of recording paper 3 measured from the top surface of the table. More specifically, as shown in FIG. 4(*b*), the curl $d_{CURL1}$ (mm) was determined as the height of one corner on the leading edge of the recording paper 3 in the conveying direction, while curls $d_{CURL2}$ (mm), $d_{CURL3}$ (mm), and $d_{CURL4}$ (mm) were determined as the heights of the remaining corners in a counterclockwise order.

The height of the stacked recording paper 3 from the top surface of the table when no curl occurs was determined as a reference height. The reference height was 30 mm in this experiment as shown in FIG. 4(*a*).

Then, the amount of curl $\Delta d_{CURLn}$ for each corner was calculated by subtracting the reference height from the height $d_{CURLn}$ of each corner of the stacked recording paper 3, where n is a natural number from 1 to 4. In other words, the following equation (1) was calculated for each number n of 1 to 4;

$$\Delta d_{CURLn} = d_{CURLn} - 30 \quad (1)$$

Then, the average value for the curls $\Delta d_{CURLn}$ of all the four corners was determined using the following equation (2):

$$\Delta d_{CURL} = (\Delta d_{CURL1} + \Delta d_{CURL2} + \Delta d_{CURL3} + \Delta d_{CURL4})/4 \quad (2)$$

The average value $\Delta d_{CURL}$ was determined as the amount of curl $\Delta d_{CURL}$ produced for the presently-set combination of the values in the parameters θ (°), $T_{HR}$ (° C.), $D_{PR}$ (mm), and $W_{NIP}$ (mm).

The amount of curl $\Delta d_{CURL}$ is positive when a tubular curl is generated in the recording paper 3 and negative when a forward curl is generated.

The above-described experiment was repeated while changing the factors θ (°), $T_{HR}$ (° C.), $D_{PR}$ (mm), and $W_{NIP}$ (mm) individually in the ranges described above. As a result, the amounts of curl $\Delta d_{CURL}$ produced for a plurality of combinations of the values in the parameters θ (°), $T_{HR}$ (° C.), $D_{PR}$ (mm), and $W_{NIP}$ (mm) were determined.

Based on the results of the above-described experiments, regression coefficients were determined for each factor θ (°), $T_{HR}$ (° C.), $D_{PR}$ (mm), $W_{NIP}$ (mm) by performing multiple regression analysis in a multivariate analysis, leading to the following multiple regression equation (3):

$$\Delta d_{CURL} = 0.55T_{HR} - 2.36\theta - 1.59D_{PR} + 8.62W_{NIP} - 124 \quad (3)$$

It is noted that the multiple regression equation is a linear equation employing a plurality of variables, expressed by the following equation:

$$y = a_1x_1 + a_2x_2 + \ldots + a_Px_P + a_0$$

wherein y corresponds to the target variable; $x_1, x_2, \ldots, x_P$ to explanatory variables; $a_0$ to a constant; and $a_1, a_2, \ldots, a_P$ to the regression coefficients.

Considering conditions, such as restrictions in the position where the fixing unit 18 can be mounted in the main casing 2 and the amount of sheets of recording paper 3 stackable on the discharge tray 46, it is preferable that the amount of curl $\Delta d_{CURL}$ should fall within a range of −10 to 20. In other words, it is preferable that the amount of curl $\Delta d_{CURL}$ should satisfy the following inequality (4):

$$-10 \leqq \Delta d_{CURL} \leqq 20 \quad (4).$$

The following inequality (5) is derived from the equation (3) and the inequality (4):

$$114 \leqq 0.55T_{HR} - 2.36\theta - 1.59D_{PR} + 8.62W_{NIP} \leqq 144 \quad (5)$$

From practical issues, such as stackability of the recording paper 3 when the recording paper 3 accumulates on the discharge tray 46 and ease of handling the print sheets of the recording paper 3, it is more preferable that the amount of curl $\Delta d_{CURL}$ should fall within another range of 5 to 10 rather than the range of −10 to 20. In other words, it is more preferable that the amount of curl $\Delta d_{CURL}$ should satisfy the following inequality (6) rather than the inequality (4):

$$-5 \leqq \Delta d_{CURL} \leqq 10 \quad (6)$$

The following inequality (7) is derived from the equation (3) and the inequality (6):

$$119 \leqq 0.55T_{HR} - 2.36\theta - 1.59D_{PR} + 8.62W_{NIP} \leqq 134 \quad (7)$$

In this example, the parameters θ (°), $T_{HR}$ (° C.), $D_{PR}$ (mm), and $W_{NIP}$ (mm) are set as follows in order to satisfy inequality (7):

Fixing Control Temperature $T_{HR}$: 190° C.
Angle of separation θ: 1.0°
Diameter $D_{PR}$: 30 mm
Nip Width $W_{NIP}$: 7.5 mm More specifically, the pressure roller 42 with the diameter $D_{PR}$ of 30 mm is mounted in the fixing unit 18. The heating roller 41 and the pressure roller 42 are disposed relative to each other so as to attain the nip width $W_{NIP}$ of 7.5 mm. The heating roller 41, the pressure roller 42, and the transport rollers 43 are disposed to attain the angle of separation θ of 1.0°. The CPU 80 sets the fixing control temperature $T_{HR}$ to 190° C. and controls the thermal fixing control unit 96 according to the presently-set fixing control temperature $T_{HR}$ so that the surface temperature $T_{HR}$ of the heating roller 41 becomes the fixing control temperature $T_{HR}$ of 190° C.

By setting the parameters θ (°), $T_{HR}$ (° C.), $D_{PR}$ (mm), and $W_{NIP}$ (mm) as described above, it is possible to decrease the amount of curl generated in the recording paper and to decrease variations in the amount of curl generated in recording paper.

It is noted that after the heating roller 41, the pressure roller 42, and the transport rollers 43 are mounted in the fixing unit 18 with the angle of separation θ of 1.0°, the diameter $D_{PR}$ of 30 mm, and the nip Width $W_{NIP}$ of 7.5 mm, even when the temperature $T_{HR}$ varies from 190° C., if the temperature $T_{HR}$ continues satisfying the inequality (7), it is possible to maintain small the amount of curl generated in the recording paper and to maintain small the variations in the amount of curl generated in recording paper. Even when the temperature $T_{HR}$ varies from 190° C., if the temperature $T_{HR}$ continues satisfying the inequality (5), it is still possible to maintain small the amount of curl generated in the recording paper. It is sufficient that the thermal fixing control unit 96 controls the surface temperature (fixing control temperature) $T_{HR}$ of the heating roller 41 to satisfy the inequality (7) or (5) after fixedly setting the other parameters θ (°), $D_{PR}$ (mm), and $W_{NIP}$ (mm) in the fixing portion 18.

Figure 6:
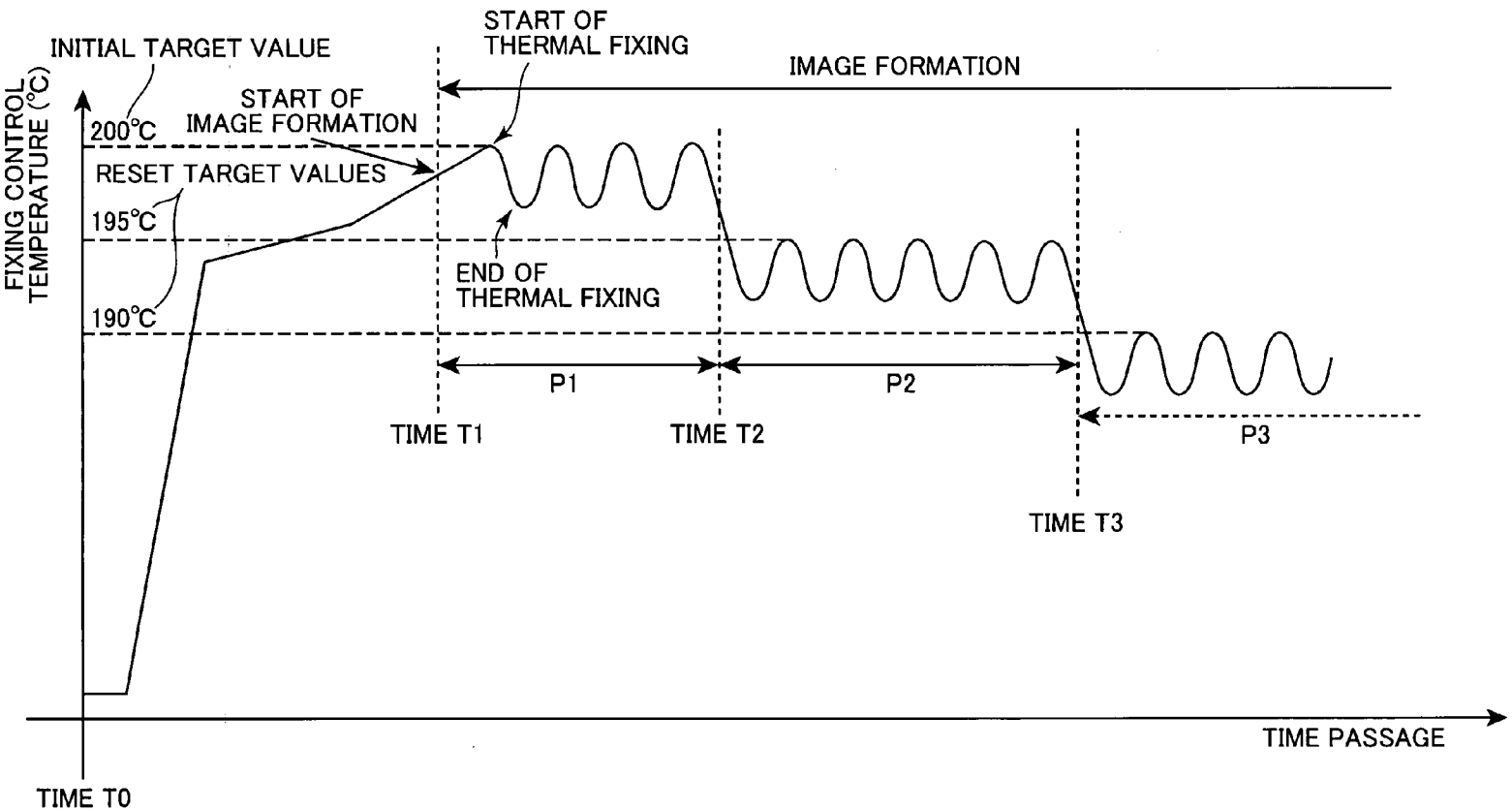
FIG. 6 is an explanatory diagram showing a process for controlling the temperature of a heating roller that is executed by the control system of the laser printer shown in FIG. 5.

Next, a printing process executed by the control system of the laser printer 1 will be described with reference to FIG. 1, FIG. 2, and FIG. 6. FIG. 6 is an explanatory diagram showing a process for controlling the temperature of the heating roller 41 executed by the control system of the laser printer 1.

It is noted that in order to fix the toner image on the recording paper 3 with heat, it is necessary to raise the surface temperature of the heating roller 41 to the softening point of the toner by the time the recording paper 3 reaches the nip part 74. The softening point of the toner is in the range of about 70 to 100° C.

When the printing process begins at time $T_0$ (FIG. 6), the CPU 80 of the control system (FIG. 5) executes a paper supply control process for feeding the recording paper 3 stacked on the paper tray 6. Specifically, the main motor rotates the feeding roller 8 at a prescribed timing and in a prescribed direction. When the feeding roller 8 rotates, the topmost sheet of the recording paper 3 stacked on the paper tray 6 is picked up from the paper tray 6 one sheet at a time by the feeding roller 8 and the separating pad 9.

A visible image is transferred onto the recording paper 3 in the process unit 17. The halogen lamp in the heating roller 41 is heated so that the surface temperature of the heating roller 41 reaches a target value, which is set slightly higher than the fixing control temperature $T_{HR}$, by the time the recording paper 3 is conveyed to the fixing unit 18. In the present embodiment, the target value is set to 200° C. at the beginning of the printing process. The process for controlling the temperature of the heating roller 41 from the start of the printing process (time $T_0$) to the beginning of image formation (time $T_1$) is performed according to a technique well known in the art and, thus, will not be described in detail herein.

As the sheet supply roller 8 further rotates, the sheet of recording paper 3 is transferred to the paper dust removing rollers 10 and 11. The paper dust removing rollers 10, 11 remove paper dust from the sheet 3 and further convey the sheet 3 to the registration rollers 12. The pair of registration rollers 12 perform the predetermined registration operation on the supplied sheet 3, and transport the sheet 3 to the image formation section 70.

Next, the development driving control is executed. More specifically, in the image forming section 70, the main motor rotates the photosensitive drum 27 in the predetermined direction.

Next, the charge bias control is executed. More specifically, in the scanner unit 16, the laser emitting section (not shown) emits a laser beam based on image data. The laser beam passes through or is reflected by the polygon mirror 19, the lens 20, the reflection mirrors 22 and 23, the lens 21, and the reflection mirror 24 in this order so as to irradiate, in a high speed scanning operation, the surface of the photosensitive drum 27 of the process unit 17. As a result, an electrostatic latent image corresponding to the image data is formed on the photosensitive drum 27.

Next, the development bias control and the transfer bias control are executed. More specifically, as the photosensitive drum 27 further rotates, toner supplied from the development cartridge 28 is attached to the area of the rotating photosensitive drum, on which the electrostatic latent image is formed. As a result, a visible image is formed on the photosensitive drum 27 based on the electrostatic latent image.

Next, a transfer bias control is executed. More specifically, when the visible image is formed on the photosensitive drum 27, the recording paper 3, which has been conveyed by the sheet supply roller 8, is conveyed by the rotating registration rollers 12 to a transfer position P, defined between the photosensitive drum 27 and the transfer roller 30, at time $T_1$ shown in FIG. 6. The recording paper 3 is pressed against the photosensitive drum 27 by the transfer roller 30, and the visible image is transferred from photosensitive drum 27 onto the sheet of recording paper 3. The sheet of recording paper 3, on which the visible image has now been transferred, is conveyed to the fixing section 18.

Next, the toner cleaning bias control is executed. More specifically, the surface of the photosensitive drum 27, from which the visible image has been transferred to the recording paper 3, is cleaned by the cleaning roller 51.

Next, the CPU 80 performs a thermal fixing control process. It is noted that the halogen lamp in the heating roller 41 has already been heated from the start of the printing process. Accordingly, the surface temperature of the heating roller 41 has approached 200° C., which is the initial setting of the target value, when the recording paper 3 reaches the fixing unit 18, that is, at the time of start of thermal fixing in FIG. 6.

Once conveyed to the fixing unit 18, the recording paper 3 passes through the nip part 74, and the heating roller 41 and pressure roller 42 fix the visible image on the recording paper 3. At this time, the surface temperature of the heating roller 41 drops as heat is absorbed by the recording paper 3 (end of thermal fixing in FIG. 6) and is subsequently raised.

It is noted that when a plurality of sheets of paper 3 are printed consecutively, the surface temperature of the heating roller 41 repeatedly drops and rises in this way. After one recording paper 3 undergoes the thermal fixing, the transport rollers 43 transport the recording paper 3 along the discharge path 44 to the discharge rollers 45, and the discharge rollers 45 discharge the recording paper 3 onto the discharge tray 46.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48 with its leading and trailing ends being reversed from the original state. The flapper 49 reverts to its initial position once transport of the sheet 3 to the inversion transport path 48 is completed. That is, the flapper 49 switches back to the position for transporting sheets from the transport rollers 43 to the sheet-discharge rollers 45. Next, the inverted sheet 3 is transported through the inversion transport path 48 to the inversion transport rollers 50 and then from the inversion transport rollers 50 to the registration rollers 12. The registration rollers 12 align the front edge of the sheet 3. Afterward, the sheet 3 is transported toward the image formation section 70. At this time, the upper and lower surfaces of the sheet 3 are reversed from the first time that an image has been formed on the sheet 3 so that an image can be formed on the other side as well. In this way, images are formed on both sides of the sheet 3.

It is noted that the curl is generated in the recording paper when the difference between the surface temperatures of the heating roller 41 and the pressure roller 42 is large. The amount of curl generated in the recording paper 3 tends to increase as the difference in temperature increases between the surface temperatures of the heating roller 41 and the pressure roller 42. The curl is generated in the recording paper also when the difference between the surface temperatures of the heating roller 41 and the pressure roller 42 is relatively small but the surface temperature of the heating roller 41 is relatively high.

As described above, the target value of the surface temperature of the heating roller 41 is first set to 200° C., which is higher than the softening point of the toner. Accordingly, the surface temperature of the heating roller 41 becomes higher than the softening point of the toner when the recording paper 3 reaches the nip part 74.

When the recording paper 3 is interposed in the nip part 74, the heating roller 41 and pressure roller 42 rotate while not contacting with each other. Accordingly, heat from the heating roller 41 does not easily transfer to the pressure roller 42. The difference between the surface temperatures of the heating roller 41 and pressure roller 42 is unlikely to be reduced. On the other hand, when the recording paper 3 is not interposed in the nip part 74, the heating roller 41 and pressure roller 42 rotate in direct contact with each other. Accordingly, heat from the heating roller 41 is transferred to the pressure roller 42, thereby decreasing the difference between the surface temperatures of the heating roller 41 and pressure roller 42.

Next, a process for controlling the temperature of the heating roller 41 executed by the control system of the laser printer 1 when printing on one side of multiple sheets of paper consecutively will be described with reference to FIG. 6.

When the laser printer 1 prints on one side of consecutive sheets of paper, the printing process described above is executed repeatedly at prescribed intervals.

During the initial period P1 at the beginning of the printing process, a large initial difference occurs between surface temperatures of the heating roller 41 and the pressure roller 42, which lowers the capacity for fixing visible images to the recording paper 3. The initial target value is therefore set slightly higher than the fixing control temperature $T_{HR}$ in order to attain a sufficiently large fixing capacity.

As a plurality of sheets of paper 3 are printed consecutively, the difference in surface temperatures of the heating roller 41 and pressure roller 42 gradually decreases, thereby increasing the capacity for fixing the visible image to the recording paper 3. If the surface temperature of the heating roller 41 were kept high even after the difference in surface temperatures of the heating roller 41 and pressure roller 42 decreases, the amount of curl in the recording paper 3 tends to increase. According to the present embodiment, therefore, the target value for control is reset to a value lower than the initial setting when the initial period P1 of the printing process has been completed.

More specifically, when printing consecutive sheets of recording paper 3, the number of sheets of recording paper 3 printed in succession is counted based on output signals from the paper sensor 76. The image formation process is started at time $T_1$. At time $T_2$, five sheets of the recording paper 3 have been consecutively printed after time $T_1$. In other words, at time $T_2$, the total number of the consecutively-printed sheets 3 reaches a predetermined threshold sheet number (five, in this example). At time $T_2$, therefore, the target value for the temperature $T_{HR}$ is reset from 200° C. to 195° C. as shown in FIG. 6. Also at time $T_2$, the CPU 80 starts measuring time. At time $T_3$, three minutes have elapsed after the time measurement was started at time $T_2$.

In other words, the measured period of time reaches a predetermined threshold time period (three minutes, in this example). At time $T_3$, the target value is reset again from 195° C. to 190° C. as shown in FIG. 6.

In this way, during the initial time period P1, defined between time $T_0$ and time $T_1$, the difference between the surface temperatures of the heating roller 41 and the pressure roller 42 is large and therefore the capacity for fixing the toner onto the sheets of recording paper 3 is small. Accordingly, the heating roller 41 is required to be heated to a relatively high temperature, and therefore is controlled to attain the target temperature of 200° C.

As the number of recording papers 3 printed increases, however, the difference between the surface temperatures of the heating roller 41 and the pressure roller 42 decreases, thereby increasing the capacity for fixing the toner onto the sheets of recording paper 3. If the heating roller 41 were still controlled to attain the target temperature of 200° C. after time $T_2$, the curl will be generated in the sheets of recording paper 3. Accordingly, at time $T_2$, the heating roller 41 is switched to a lowest target temperature (195° C., in this example) that can presently prevent generation of curl in the recording papers 3 but still that can presently maintain a sufficient capacity for fixing the toner onto the sheets of recording paper 3.

Similarly, after time $T_2$, as the number of recording papers 3 printed increases, the difference between the surface temperatures of the heating roller 41 and the pressure roller 42 further decreases, thereby increasing the capacity for fixing the toner onto the sheets of recording paper 3. If the heating roller 41 were still controlled to attain the target temperature of 195° C. after time $T_3$, the curl will be generated in the sheets of recording paper 3. Accordingly, at time $T_3$, the heating roller 41 is switched to a lowest target temperature (190° C., in this example) that can presently prevent generation of curl in the recording papers 3 but still that can presently maintain a sufficient capacity for fixing the toner onto the sheets of recording paper 3.

In this way, during a second time period P2, that is, between time $T_2$ and $T_3$, the heating roller 41 is controlled to the lowest target temperature (195° C.) that properly prevents generation of curl in the recording papers 3 but that ensures fixing of the toner onto the sheets of recording paper 3. Similarly, during a third time period P3, that is, after time $T_3$, the heating roller 41 is controlled to the lowest target temperature (190° C.) that properly prevents generation of curl in the recording papers 3 but still that ensures fixing of the toner onto the sheets of recording paper 3.

It is conceivable to determine values of the factors θ (°), $T_{HR}$ (° C.), $D_{PR}$ (mm), and $W_{NIP}$ (mm), during the prototyping stage of the laser printer 1, for each type of toner and each type of recording paper that will possibly be used with the laser printer 1 by repeatedly measuring the amount of curl generated in the recording paper while making fine adjustments to each factor. This is because the type of toner, the amount of toner deposited on the recording paper 3, and the bending strength of the recording paper can also affect the amount of curl. However, this conceivable process will entail a tremendous number of steps and, hence, enormous cost. Further, after setting design specifications on the laser printer 1 through experiments, the same experiments have to be executed again when the design specifications are changed, The manufacturer of the laser printer 1 has to perform the experiments every time a new model is designed.

Contrarily, according to the laser printer 1 of the present embodiment, since the factors $T_{HR}$ (° C.), θ (°), $D_{PR}$ (mm), and $W_{NIP}$ are preset to satisfy inequality (5) or (7), it is possible to minimize the amount of curl generated in the recording paper 3 without having to repeatedly execute experiments.

The target value of the temperature is reset to a value lower than the initial setting after the total number of consecutively-printed sheets reaches the predetermined threshold sheet number, thereby reducing the amount of curl in the recording paper 3, while maintaining sufficiently large capacity for fixing the visible images to the recording paper 3. By reducing the temperature of the heating roller 41, rather than maintaining the target value of the temperature at the initial setting, it is possible to reduce the amount of power consumed by the heating roller 41.

The threshold sheet number can be previously established through experimentation. If heat is less likely to transfer from the heating roller 41 to the pressure roller 42 when printing on consecutive sheets of paper, by setting the threshold sheet number to a relatively large value based on the experimentation result, it is possible to reset the target temperature to a lower value when the difference between the surface temperatures of the heating roller 41 and the pressure roller 42 decreases to a relatively small value. Accordingly, it is possible to decrease the amount of curl produced in recording paper.

By reducing the temperature of the heating roller 41 rather than maintaining the surface temperature of the roller 41 at a fixed temperature, it is possible to reduce the amount of power consumed by the heating roller 41.

<Modifications>

In the present embodiment, when printing on consecutive sheets of paper, the target value of the temperature is reset from 200° C. to 195° C. after the first five sheets of paper have been printed and subsequently reset from 195° C. to 190° C. when three minutes have elapsed after resetting the target value to 195° C. However, the intervals for switching the target value of the temperature, the number of temperature changes, and the target values of temperature may be set in a variety of ways based on experimentation in order to minimize the amount of curl generated in the recording paper 3 while ensuring that the visible images are reliably fixed to the recording paper 3.

For example, the target value of the temperature may be reset for the first time after printing the first ten consecutive sheets of paper from the start of the image formation process ($T_1$) and reset for the second time after printing fifty consecutive sheets of paper from the start of the image formation process ($T_1$).

The target value may be reset from the initial value 200° C. to 195° C. after five sheets of recording paper have passed through the nip part 74 from the start of the image formation process ($T_1$). The target value may subsequently be reset from 195° C. to 190° C. after thirty sheets of recording paper have passed through the nip part 74 from the start of the image formation process ($T_1$).

The target value of the surface temperature can be reset to a value lower than the initial setting when a threshold time period has been elapsed after the start of the image formation process ($T_1$). As one specific example, the CPU 80 starts measuring time after detecting in output signals from the paper sensor 76 that the first sheet of recording paper 3 from among multiple sheets to be printed consecutively has been conveyed from the fixing unit 18. The target value of the temperature is reset from 200° C. to 195° C. when a first threshold time period (one minute, in this example) has elapsed since the start of the image formation process ($T_1$).

The target value is again reset to 190° C. when a second threshold time period (three minutes, in this example) has elapsed since the start of the image formation process ($T_1$). The lengths of the threshold time periods (one minute and three minutes, in this example) can be previously determined through experimentation.

It is noted that the target value of the temperature may be reset in three or more times.

The amount of power consumed by the heating roller 41 can be decreased by lowering the target value for the surface temperature of the heating roller 41 at multiple times, rather than lowering the target value just once.

Second Embodiment

Next, a laser printer 101 according to a second embodiment will be described with reference to FIG. 7(*a*)-FIG. 9.

In the following description, the left side in FIG. 7(*a*) will be referred to as the front of the laser printer 101, while the right side will be referred to as the rear of the laser printer 101. Further, the top side in FIG. 7(*a*) will be referred to as the top of the laser printer 101, while the bottom side will be referred to as the bottom of the laser printer 101. In addition, the near side in FIG. 7(*a*) will be referred to as the right side of the laser printer 101, while the far side will be referred to as the left side of the laser printer 101.

Figure 7A:
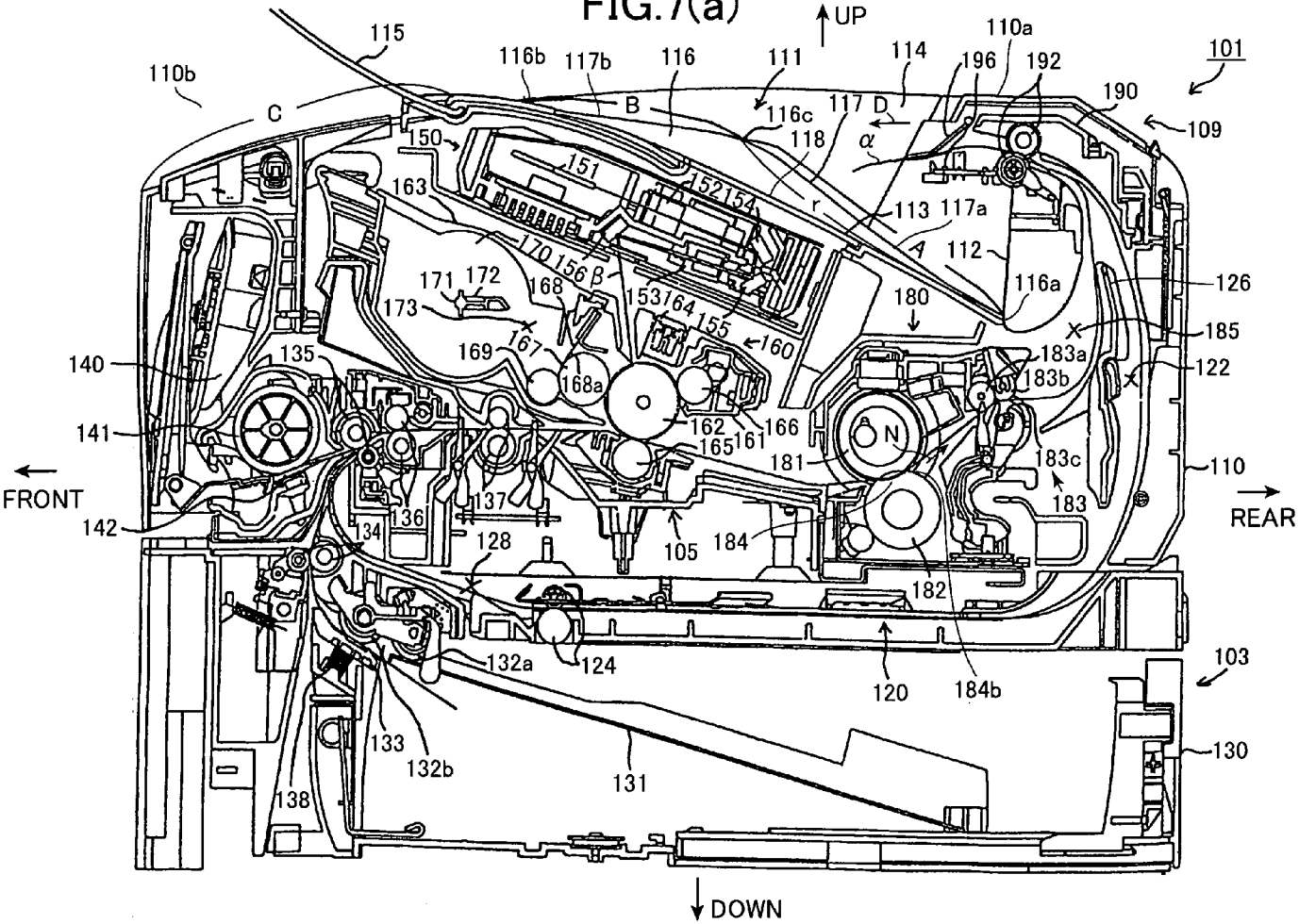
FIG. 7(*a*) is a side cross-sectional view showing a laser printer according to a second embodiment.
Figure 7B:
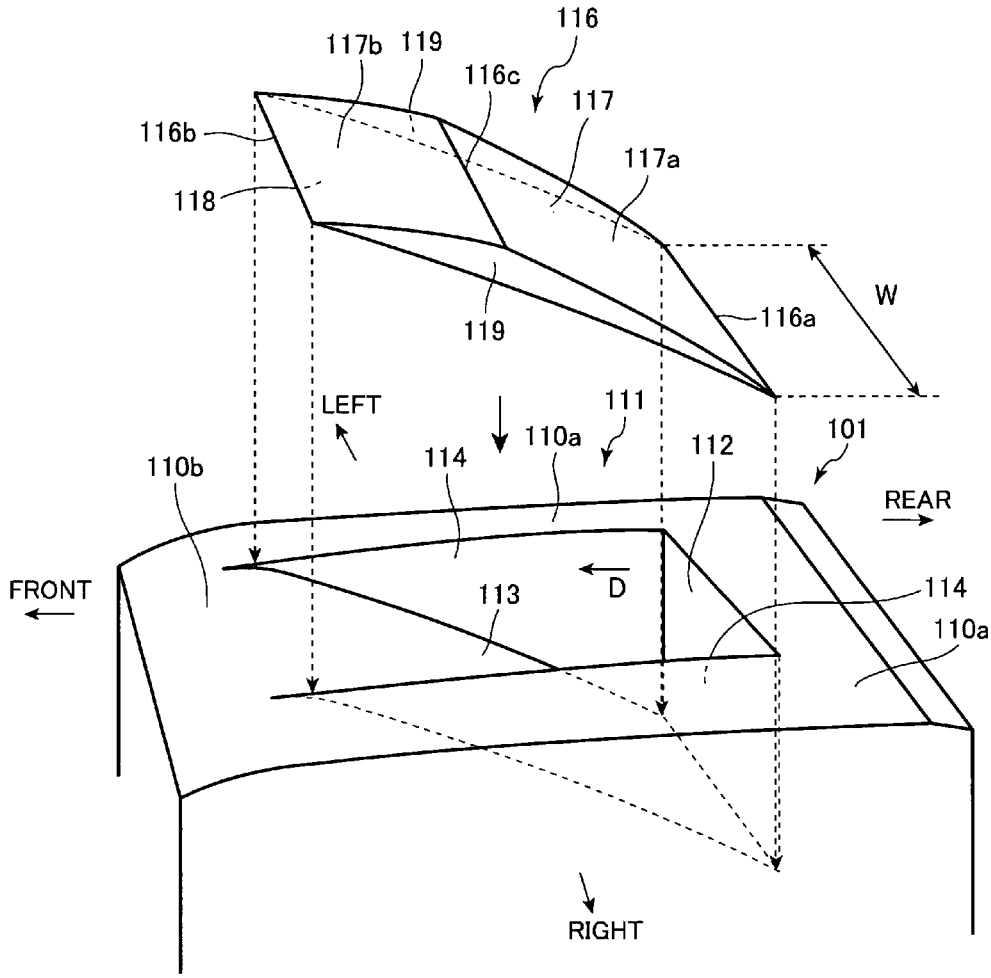
Figure 7C:
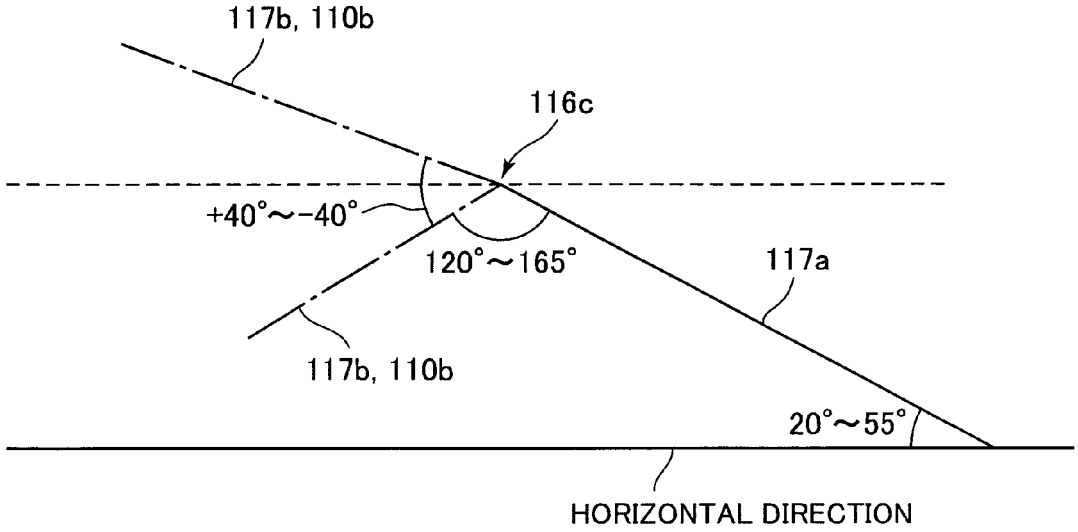

As shown in FIG. 7(*a*), the laser printer 101 includes: a feeder section 103, an image forming section 105, and a paper discharging section 109. The feeder section 103, the image forming section 105, and the paper discharging section 109 are housed in a main casing 110 of the laser printer 101. The feeder section 103 supplies sheets α to the image forming section 105. The image forming section 105 forms desired images on the supplied sheets α. The paper discharging section 109 is for discharging the sheets α printed with the images by the image forming section 105 in a paper discharging direction D. The paper discharging direction D is parallel to the rear-to-front direction of the laser printer 101. The left-to-right direction of the laser printer 101 is orthogonal to the paper discharging direction D and therefore perpendicular to the surface of the sheet of FIG. 7(*a*).

The feeder section 103 includes: a paper supply tray 130, a paper pressing plate 131, a pair of sheet supply rollers 132 (132*a* and 132*b*), a sheet supply pad 133, registration rollers 134 and 135, paper dust removing rollers 136, and registration rollers 137. The paper supply tray 130 is detachably mounted in the bottom portion of the main casing 110. The paper pressing plate 131 is disposed inside the paper supply tray 130. The pair of sheet supply rollers 132 and the sheet supply pad 133 are disposed above one end of the paper supply tray 130. The registration rollers 134 and 135 are disposed downstream of the sheet supply rollers 132 in the conveying direction of the paper α. The paper dust removing rollers 136 are disposed downstream of the registration rollers 136 in the conveying direction of the paper α. The registration rollers 137 are disposed downstream of the paper dust removing rollers 136 in the conveying direction of the paper α.

The paper pressing plate 131 is capable of supporting a stack of sheets α. The paper pressing plate 131 is pivotably supported at its end furthest from the sheet supply rollers 132 so that the end of the paper pressing plate 131 that is nearest the sheet supply rollers 132 can move vertically. Although not shown in the drawing, a spring for urging the sheet pressing plate 131 upward is provided to the rear surface of the sheet pressing plate 131. Accordingly, the sheets of paper α stacked on the sheet pressing plate 131 are in abutment contact with one sheet supply roller 132*a*. Therefore, the sheet pressing plate 131 pivots downward in accordance with increase in the amount of sheets α stacked on the sheet pressing plate 131. At this time, the sheet pressing plate 131 pivots around the end of the sheet pressing plate 131 farthest from the sheet supply rollers 132, downward against the urging force of the spring.

The other sheet supply roller 132*b*, which is located downstream of the sheet supply roller 132*a*, and the sheet supply pad 133 are disposed in confrontation with each other. A spring 138 is provided beneath the sheet supply pad 133 for pressing the sheet supply pad 133 toward the sheet supply roller 132*b*.

The uppermost sheet α on the sheet pressing plate 131 is conveyed downstream by the rotation of the sheet supply roller 132*a*, and is sandwiched between the sheet supply roller 132*b* and the sheet supply pad 133. As a result, one sheet α is supplied at a time. The sheet α is conveyed downstream by the registration rollers 134 and 135. After paper dust is removed from the sheet by the paper dust removing rollers 136, the sheet is conveyed to the registration rollers 137. The pair of registration rollers 137 perform a registration operation onto the sheet α, and supplies the sheet to the image forming section 105.

The feeder section 103 further includes a multipurpose tray 140, a multipurpose sheet supply roller 141, and a multipurpose sheet supply pad 142. The multipurpose sheet supply roller 141 and the multipurpose sheet supply pad 142 are for supplying sheets α that are stacked on the multipurpose tray 140. The multipurpose sheet supply roller 141 and the multipurpose sheet supply pad 142 are disposed in confrontation with each other. A spring (not shown) is disposed to the underside of the multipurpose sheet supply pad 142. The urging force of the spring presses the multipurpose sheet supply pad 142 against the multipurpose sheet supply roller 141. Rotation of the multipurpose sheet supply roller 141 pinches the uppermost sheet α of the stack on the multipurpose tray 140 between the multipurpose sheet supply roller 141 and the multipurpose sheet supply pad 142. Thus, the sheets α are supplied one at a time. The sheet α is further conveyed downstream by the registration rollers 135. Paper dust is removed from the sheet α by the paper dust removing rollers 136, and are supplied to the registration rollers 137. The pair of registration rollers 137 perform the registration operation onto the sheet α, before supplying the sheet α to the image forming section 105.

The image forming section 105 includes: a scanner unit 150, a process unit 160, and a fixing section 180.

The scanner unit 150 is provided at the upper section of the casing 110 and is provided with a laser diode (not shown), a rotatingly driven polygon mirror 151, lenses 152 and 153, and reflection mirrors 154, 155, and 156. The laser diode emits a laser beam based on desired image data. The laser beam passes through or is reflected by the polygon mirror 151, the lens 152, the reflection mirrors 154 and 155, the lens 153, and the reflection mirror 156 in this order so as to irradiate, in a high speed scanning operation, the surface of the photosensitive drum 162 of the process unit 160.

The process unit 160 is disposed below the scanner unit 150. The process unit 160 has a drum cartridge 161, which is attachable to and detachable from the casing 110. The process unit 160 has, within the drum cartridge 161, the photosensitive drum 162, a developing cartridge 163, a scorotron charge unit 164, a transfer roller 165, and an electrically conductive brush 166.

The developing cartridge 163 is attachable to and detachable from the drum cartridge 161. The developing cartridge 163 is provided with: a toner box 170; a supply roller 169, a developing roller 167, and a layer thickness regulating blade 168.

The toner box 170 is filled with positively charged, non-magnetic, single-component toner as a developing agent. For the toner, polymer toner obtained as a result of copolymerizing monomers by following a well-known polymerization technique such as suspension polymerization is used. Examples of polymerizable monomers are styrene monomers such as styrene, and acrylic monomers such as acrylic acid, alkyl (C1-C4) acrylate, alkyle (C1-C4) metaacrylate. Such polymerized toner has substantially sphere shape, and possesses extremely desirable fluidity. Furthermore, a colorant such as carbon black, and wax are combined in such toner. An external agent such as silica is externally attached to the polymerized toner to enhance the fluidity. The average diameter of the particle is approximately between 6 to 10 μm.

A rotation shaft 171 is disposed in the center of the toner box 170. An agitator 172 is supported on the rotation shaft 171. The agitator 172 rotates and agitates the toner in the toner box 170 and discharges the toner through a toner supply opening 173 that is opened through the side wall of the toner box 170.

The supply roller 169 is located on the side of the toner supply opening 173. The developing roller 167 is located confronting the supply roller 169. The supply roller 169 and the developing roller 167 are supported rotatably. The supply roller 169 and the developing roller 167 are disposed in abutment contact with each other so that both are compressed to a certain extent.

The supply roller 169 includes a metal roller shaft covered with a roller formed from an electrically conductive sponge material. The developer roller 167 includes a metal roller shaft and a roller portion covered thereon. The roller portion is made from a conductive rubber material. In more specific terms, the roller portion of the developing roller 167 is made from conductive silicone rubber or urethane rubber including, for example, carbon particles. The surface of the roller portion is covered with a coating layer of silicone rubber or urethane rubber that contains fluorine. The developing roller 167 is applied with a developing bias relative to the photosensitive drum 162.

The layer thickness regulating blade 168 is disposed near the developing roller 167. The layer thickness regulating blade 168 includes a blade made from a metal leaf spring, and has a pressing member 168*a*, that is provided on a free end of the blade. The pressing member 168*a* has a semicircular shape when viewed in cross section. The pressing member 168*a* is formed from silicone rubber with electrically insulating properties. The layer thickness regulating blade 168 is supported by the developing cartridge 163 at a location near the developing roller 167. The resilient force of the blade presses the pressing member 168*a* against the surface of the developing roller 167.

The rotation of the supply roller 169 supplies the developing roller 167 with toner that has been discharged through the toner supply opening 173. At this time, the toner is triboelectrically charged to a positive charge between the supply roller 169 and the developing roller 167. Then, as the developing roller 167 rotates, the toner supplied onto the developing roller 167 moves between the developing roller 167 and the pressing member of the layer thickness regulating blade 168. This further triboelectrically charges the toner, and reduces thickness of the toner on the surface of the developing roller 167 down to a thin layer of uniform thickness.

The photosensitive drum 162 is disposed to the side of and in confrontation with the developing roller 167. The photosensitive drum 162 is supported rotatably. The photosensitive drum 162 includes a drum-shaped member and a surface layer. The drum-shaped member is connected to ground. The surface layer is formed from a photosensitive layer that is made from polycarbonate and that has a positively charging nature.

The scorotoron charge unit 164 is disposed above the photosensitive drum 162 and is spaced away from the photosensitive drum 162 by a predetermined space so as to avoid direct contact with the photosensitive drum 162. The scorotron charge unit 164 is a positive-charge scorotron type charge unit for generating a corona discharge from a charge wire made from, for example, tungsten. The scorotoron charge unit 164 forms a blanket of positive-polarity charge on the surface of the photosensitive drum 162.

As the photosensitive drum 162 rotates, the scorotoron charge unit 164 first forms a blanket of positive charge on the surface of the photosensitive drum 162, and then the surface of the photosensitive drum 162 is exposed to high speed scan of the laser beam from the scanner unit 150. The electric potential of the positively charged surface of the photosensitive drum 162 drops at positions exposed to the laser beam. As a result, an electrostatic latent image is formed on the photosensitive drum 162 based on desired image data used to drive the laser beam.

Next, an inverse developing process is performed. That is, as the developing roller 167 rotates, the positively-charged toner borne on the surface of the developing roller 167 is brought into contact with the photosensitive drum 162. Because of the developing bias voltage applied to the developing roller 167, the toner on the developing roller 167 is supplied to lower-potential areas of the electrostatic latent image on the photosensitive drum 162. As a result, the toner is selectively borne on the photosensitive drum 162 so that the electrostatic latent image is developed into a visible toner image.

The transfer roller 165 is rotatably supported at a position below and in confrontation with the photosensitive drum 162. The transfer roller 165 is rotatably supported in the drum cartridge 161. The transfer roller 165 includes a metal roller shaft and a roller portion covering the shaft and made from resilient member added with ionic material, such as lithium perchlorate. The transfer roller 165 can transfer the visible toner image borne on the surface of the photosensitive drum 162 to a sheet α, while conveying the sheet α properly.

At times of toner image transfer, a transfer bias applying circuit (not shown) applies the transfer roller 165 with a predetermined transfer bias relative to the photosensitive drum 162. The visible toner image borne on the surface of the photosensitive drum 162 confronts the transfer roller 165 and is transferred onto a sheet α as the sheet α passes between the photosensitive drum 162 and the transfer roller 165.

The conductive brush 166 is provided to contact the surface of the photosensitive drum 162 at a position that is downstream of the transfer roller 165 and upstream of the scorotron charge unit 164 in the rotating direction of the photosensitive drum 162. The conductive brush 166 removes paper dust, which is attached to the photosensitive drum 162 after transfer operation has been executed.

The fixing section 180 is disposed to the side of the process unit 160 and downstream of the same in the conveying direction of the paper α. The fixing section 180 includes a heating roller 181, a pressure roller 182 applying pressure to the heating roller 181, and transport rollers 183. The transport rollers 183 are disposed downstream of the heating roller 181 and the pressure roller 182.

The heating roller 181 has the same configuration with the heating roller 41 in the first embodiment. The pressure roller 182 has the same configuration with the pressure roller 42 in the first embodiment.

In the fixing section 180, the heat generated by the halogen lamp thermally fixes the toner, which has been transferred to the sheet α by the process unit 160, onto the sheet α while the sheet α passes through a nip part 184 between the heating roller 181 and the pressure roller 182. Thereafter, the sheet α is transferred to the sheet discharging section 109 by the transport rollers 183.

The transport rollers 183 include: a pair of small-diameter rollers 183*a* and 183*b*; and a large-diameter roller 183*c*. The pair of small-diameter rollers 183*a* and 183*b* are located with their axes being parallel with each other. The large-diameter roller 183*c* is disposed in confrontation with the small-diameter rollers 183*a* and 183*b*. The transport rollers 183 transport the sheet α by allowing the sheet α to pass between the small-diameter rollers 183*a* and 183*b* and the large-diameter roller 183*c*.

It is noted that the heating roller 181 and the pressure roller 182 function in the same manner as the heating roller 41 and the pressure roller 42 in the first embodiment. The transport rollers 183 function in the same manner as the transport rollers 43 in the first embodiment. Similarly to the manner as shown in FIG. 3, the nip part 184 is defined between the heating roller 181 and the pressure roller 182. A discharging direction N, in which the recording paper is discharged from a downstream end 184*b* of the nip part 184 to the transport rollers 183, is determined dependently on the positions of the rollers 183*a*, 183*b*, and 183*c* relative to the downstream end 184*b*. The angle of separation θ (°) is defined between the discharging direction N and a tangent to the heating roller 181 at the downstream end 184*b* of the nip part 184.

The sheet discharging section 109 includes a discharge unit 190, within which a pair of discharge rollers 192 are provided. The sheet α is discharged by the sheet-discharge rollers 192 through a discharge through-hole (not shown) formed in the main casing 110 in the paper discharging direction D. The sheet α is discharged onto a sheet discharge tray 111.

The sheet discharging section 109 further includes a discharge sensor 196 at the downstream side of the sheet-discharge rollers 192. The discharge sensor 196 detects whether or not a sheet of paper α is discharged onto the sheet discharge tray 111 by the sheet-discharge rollers 192.

The laser printer 101 is further provided with an inverting transport section 120 for inverting sheets α that have been printed on once and for returning the sheets α to the image forming section 105 so that images can be formed on both sides of the sheets α. The inverting transport section 120 includes the sheet-discharge rollers 192, an inversion transport path 122, a flapper 126, and inversion transport rollers 124.

The sheet-discharge rollers 192 are a pair of rollers that can be rotated selectively forward or in reverse. The sheet-discharge rollers 192 are rotated forward to discharge sheets α onto the sheet discharge tray 111 and rotated in reverse when sheets are to be inverted.

The inversion transport path 122 extends through the side of the fixing section 180 to the location below the process unit 160 so as to convey the sheets α from the sheet-discharge roller 192 to the inversion transport rollers 124 that are located below the image forming section 105. The upstream end of the inversion transport path 122 is located near the sheet-discharge rollers 192 and the downstream end is located near the inversion transport rollers 124.

The inversion transport rollers 124 are located at the downstream end of the inversion transport path 122 and near to the sheet supply rollers 132.

The flapper 126 is provided facing the junction between a discharge path 185 and the inversion transport path 122. The flapper 126 is formed to prevent the inverted sheet α from being sent to the discharge path 185.

A re-transport path 128 is provided in the downstream side of the inversion transport rollers 124. The re-transport path 128 is for transporting the sheet α, which has been transported from the inversion transport rollers 124, above the sheet supply rollers 132 and the registration rollers 134 to the registration rollers 135.

The inverting transport section 120 operates in the following manner when a sheet α is to be formed with images on both sides.

A sheet α that has been formed on one side with an image is transported by the transport rollers 183 from the discharge path 185 to the sheet-discharge rollers 192. The sheet-discharge rollers 192 rotate forward with the sheet α pinched therebetween until almost all of the sheet α is transported out from the laser printer 101 and over the sheet discharge tray 111. The forward rotation of the sheet-discharge rollers 192 is stopped once the rear-side end of the sheet α is located between the sheet-discharge rollers 192. Then, the sheet-discharge rollers 192 are driven to rotate in reverse, as a result of which the sheet α is transported through the inversion transport path 122 to the inversion transport rollers 124 and then from the inversion transport rollers 124 through the re-transport path 128 to the registration rollers 135. The registration rollers 135 align the front edge of the sheet α. Afterward, the sheet α is transported toward the image formation section 5. At this time, the upper and lower surfaces of the sheet α are reversed from the first time that an image has been formed on the sheet α so that an image can be formed on the other side as well. In this way, images are formed on both sides of the sheet α.

The laser printer 101 uses the developing roller 167 to collect residual toner that remains on the surface of the photosensitive drum 162 after toner is transferred onto the sheet α via the transfer roller 165. In other words, the laser printer 101 uses a "cleanerless development method" to collect the residual toner. By using the cleanerless development method to collect residual toner, there is no need to provide a separate member, such as a blade, for removing the residual toner or an accumulation tank for the waste toner. Therefore, the configuration of the laser printer can be simplified.

Next, the sheet discharge tray 111 will be described. As shown in FIG. 7(*a*) and FIG. 7(*b*), the sheet discharge tray 111 of the laser printer 101 is of a concave shape and formed by digging a space out of a top surface (top wall) 110*a* of the main casing 110. It is noted that in FIG. 7(*b*), a cover 115 to be described later, the discharge rollers 192, or the discharge sensor 196 is not shown for clarity purpose.

The sheet discharge tray 111 has: a vertical rear surface (vertical rear wall) 112, a bottom surface (bottom wall) 113; and a pair of vertical side surfaces (vertical side walls) 114. The sheet discharge tray 111 has a substantially triangular-shaped side cross-section. The rear end of the bottom surface 113 is deeper than the front end of the bottom surface 113. The front end of the bottom surface 113 is continuous with a front portion 110*b* (region C.) of the top surface 110*a*.

The vertical rear surface 112 provides the rear edge of the sheet discharge tray 111 near the sheet-discharge rollers 192. The vertical rear surface 112 serves as a trailing edge contact surface functioning as a stopper for contacting the trailing edges of discharged sheets of paper α. As shown in FIG. 7(*a*), the sheet-discharge rollers 192 are disposed at the top end of the trailing edge contact surface 112, and the discharge sensor 196 is provided in front (on the downstream side) of the sheet-discharge rollers 192.

The bottom surface 113 of the sheet discharge tray 111 slants upward from the bottom end of the trailing edge contact surface 112 to the front edge of the sheet discharge tray 111 that opposes the sheet-discharge rollers 192. That is, the bottom surface 113 slants upward in the paper discharging direction D in which the paper α is discharged from the sheet-discharge rollers 192, until reaching the front part 110*b* of the top surface 110*a*. The scanning unit 150 is disposed along the underside of the bottom wall 113 (inside the main casing 110).

Side surfaces 114 are located on the left and right sides of the bottom surface 113, and extend vertically. The side surfaces 114 extend perpendicularly to the bottom surface 113. The side surfaces 114 have a substantially triangular shape.

As shown in FIG. 7(*a*), the cover 115 is detachably and rotatably attached to the top surface 110*a* of the main casing 110 on the front edge of the bottom surface 113 opposing the sheet-discharge rollers 192. The cover 115 is large enough to cover the entire portion of the sheet discharge tray 111 that is open in the top of the main casing 110. When moved to the closed position, the cover 115 covers the sheet discharge tray 111. When moved to the open position shown in FIG. 7(*a*), the cover 115 forms a surface continuous with the bottom surface 113, and slants further upward from the main casing 110 in the paper discharging direction D. As shown in FIG. 7(*a*), the front part 110*b* of the top surface 110*a* is located farther downstream from the position, at which the cover 115 is attached to the top surface 110*a*, in the paper discharging direction D.

A replaceable adaptor 116 is mounted in the sheet discharge tray 111 on the bottom surface 113.

The replaceable adaptor 116 can be mounted on and removed from the bottom surface 113 and is large enough to cover substantially the entire bottom surface 113.

As shown in FIG. 7(*b*), the replaceable adaptor 116 is approximately of a triangular prism shape. The replaceable adaptor 116 has: a top surface 117; a bottom surface 118; and a pair of opposite side surfaces 119.

The replaceable adaptor 116 further includes a rear edge 116*a*, a front edge 116*b*, and a crest 116*c*. The top surface 117 is connected to the bottom surface 118 at both of the rear edge 116*a* and the front edge 116*b*. The top surface 117 protrudes away from the bottom surface 118, and is the farthest away from the bottom surface 118 at the crest 116*c*. The side cross-section of the top surface 117 is curved approximately in a parabola curve from the rear edge 116*a* over the crest 117*c* to the front edge 116*b*. The top surface 117 has: a rear surface part 117*a* (region A) which is defined between the rear edge 116*a* and the crest 116*c*; and a front surface part 117*b* (region B) which is defined between the front edge 116*b* and the crest 116*c*. The top surface 117 therefore functions as a curved stacking surface.

The pair of opposite side surfaces 119 are formed perpendicularly to both of the bottom surface 118 and the top surface 117. Each side surface 119 is approximately of a triangular shape.

When the replaceable adaptor 116 is mounted on the sheet discharge tray 111, the bottom surface 118 confronts the bottom surface 113 of the sheet discharge tray 111, the pair of opposite side surfaces 119 face the pair of opposite side surfaces 114 of the sheet discharge tray 111, and the front surface part 117*b* is continuous with the front part 110*b* of the top surface 110*a*.

The top surface 117 of the replaceable adaptor 116 has a predetermined width W in a direction orthogonal to the paper discharging direction D over the entire region from the rear edge 116*a* through the crest 116*c* toward the front edge 116*b*. The width W is greater than a width of the paper α defined in a direction : orthogonal to the paper discharging direction D, in which the paper α is discharged. For example, if it is desired to print on a A4 size sheet of paper α while conveying the sheet α in a sheet conveying direction with a leading edge of the sheet α being one of the two shorter sides and with a trailing edge of the sheet being the other of the two shorter sides, the width W of the top surface 117 is set greater than the width (210 mm) of the A4 sized paper α defined in the direction orthogonal to the paper discharging direction D (the widthwise dimension of A4-size paper).

Although the replaceable adaptor 116 can be hollow, the replaceable adaptor 116 is solid in this example.

Figure 8A:
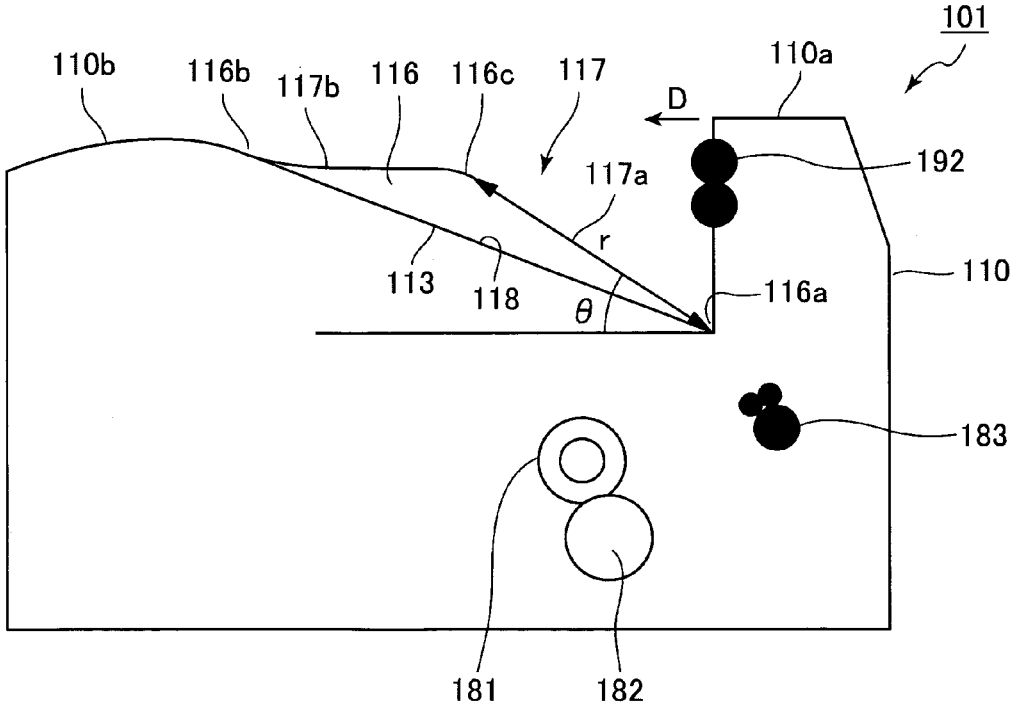
FIG. 8(*a*) is an explanatory diagram illustrating a length r and an angle θ of the replaceable adaptor in the laser printer according to the second embodiment.
Figure 8B:
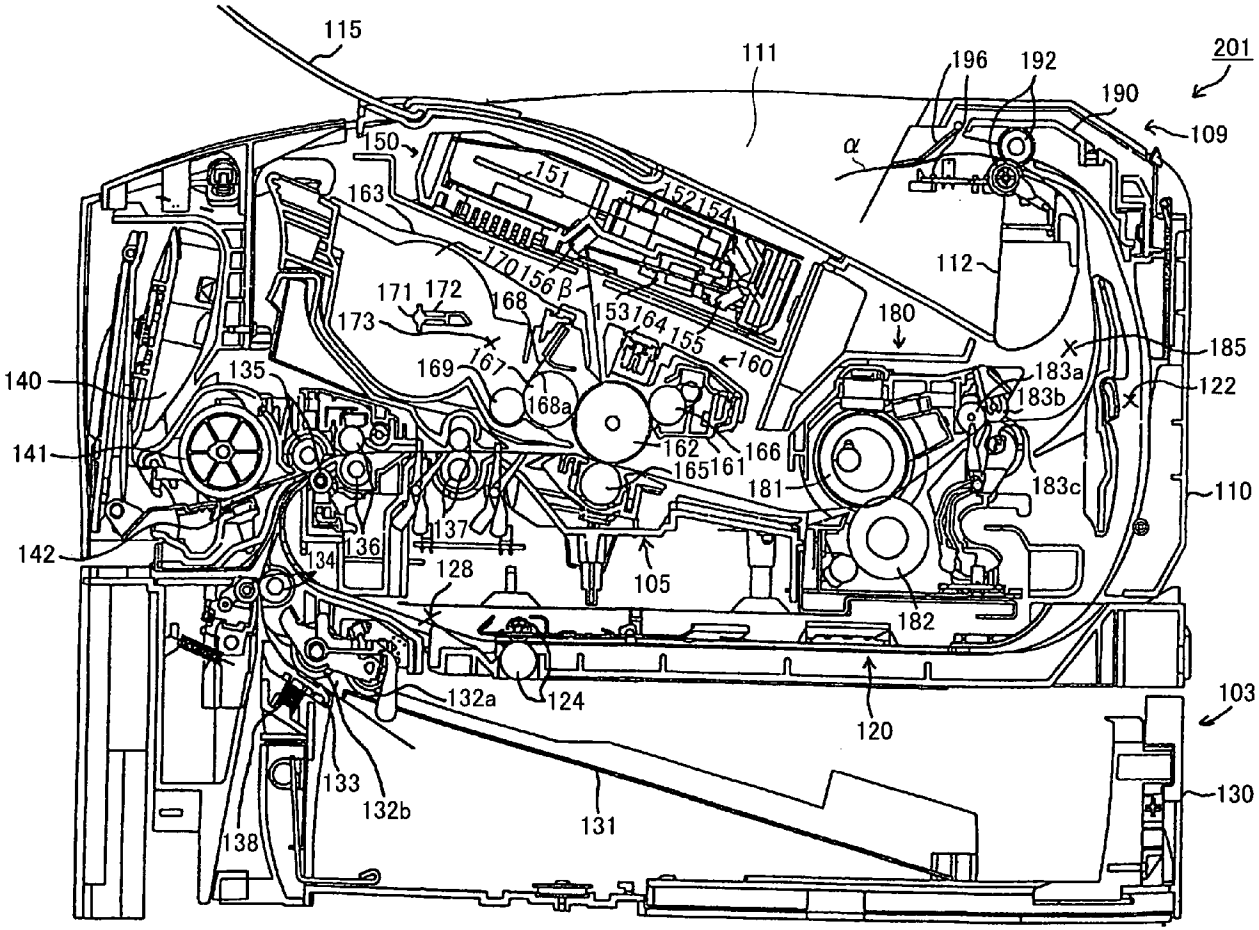

Thus, the replaceable adaptor 116 is formed with the top surface (curved stacking surface) 117. The side cross-section of the top surface 117 extends approximately in a parabola curve. The top surface 117 protrudes or rises upwardly in the middle thereof. When the replaceable adaptor 116 is mounted over the bottom surface 113, as shown in FIG. 8(*a*), the top surface 117 extends from the bottom of the trailing edge contact surface 112 on the upstream end of the bottom surface 113 to the downstream end of the bottom surface 113 with respect to the paper discharging direction D. In other words, the replaceable adaptor 116 is mounted over the bottom surface 113 with its rear end 116*a* being located on the upstream end of the bottom surface 113 and its front end 116*b* being located on the downstream end of the bottom surface 113 with respect to the paper discharging direction D.

The replaceable adaptor 116 has the uniform width W, which is larger than the paper width.

A length r indicated in FIG. 7(*a*) and FIG. 8(*a*) of the region A from the rear end 116*a* to the crest 116*c* is preferably approximately one-half the length of a sheet of paper α in the paper discharging direction D. More specifically, the length r is preferably within a range of 40% to 60%, and more preferably within another range of 45% to 55% of the length of a sheet of paper α in the paper discharging direction D (the longitudinal dimension of the paper α in this example). For example, if it is desired to print on a A4 size sheet of paper α while conveying the sheet α in a sheet conveying direction with a leading edge of the sheet α being one of the two shorter sides and with a trailing edge of the sheet being the other of the two shorter sides, the length r is preferably within a range of 40% to 60%, and more preferably within another range of 45% to 55% of the length (298 mm) of a sheet of A4-size paper in the paper discharging direction D (the longitudinal dimension of A4-size paper). In this example, the length r from the rear end 116*a* to the crest 116*c* is set one-half the length of a sheet of A4-size paper in the paper discharging direction D.

The top surface 117 has an area sufficiently large to receive a recording paper α stacked thereon. In other words, the sum of the areas of the rear surface part 117*a* (region A) and of the front surface part 117*b* (region B) is greater than or equal to the area of a recording paper α stacked thereon. For example, if it is desired to print on a A4 size sheet of paper α, the top surface 117 has an area sufficiently large to receive an A4-size recording paper α stacked thereon.

The rear surface part 117*a* slants upward at an angle (θ=in FIG. 8(*a*)) with respect to the horizontal. The value of the angle θ preferably falls within a range of 20° to 55° (range of greater than or equal to 20° and smaller than or equal to 55°), more preferably within another range of 27° to 50° (range of greater than or equal to 27° and smaller than or equal to 50°), and most preferably within still another range of 33° to 40° (range of greater than or equal to 33° and smaller than or equal to 40°). In this example, the rear surface part 117*a* slants upward at an angle of 30° to the horizontal (θ=30° in FIG. 8(*a*)).

An angle formed between the rear surface part 117*a* and the front surface part 117*b* is preferably within a range of 120° to 165° (range of greater than or equal to 120° and smaller than or equal to 165°), and more preferably within another range of 130° to 150° (range of greater than or equal to 130° and smaller than or equal to 150°). As shown in FIG. 7(*c*), because the angle θ is preferably 20° to 55°, it is preferable that the front surface part 117*b* forms an angle within a range of −40° to +40° (range of greater than or equal to −40° and smaller than or equal to +40°) with respect to the horizontal so that the paper α will not move in the paper discharging direction D due to its own weight to fall off the front surface part 117*b*. Similarly, it is preferable that the front part 110*b* of the top surface 110*a* of the main casing 110 forms an angle within a range of −40° to +40° with respect to the horizontal so that the paper α will not move in the paper discharging direction D due to its own weight to fall off the front part 110*b* of the top surface 110*a*. It is ensured that even when the cover 115 is detached from the main casing 110, the paper α will not move in the paper discharging direction D due to its own weight to fall off the laser printer 101.

When the paper α is stacked on the curved stacking surface 117 on the sheet discharge tray 111, the middle of the paper α is raised in its side-section along the paper discharging direction D. Therefore, inward displacement of the widthwise edges of the paper α is restricted, preventing the generation of tubular curl.

More specifically, the paper α contains moisture equivalent to several percents of its weight. Some of this moisture evaporates when the paper α passes between the heating roller 181 and the pressure roller 182. However, a larger amount of moisture evaporates from the front side of the paper α, on which the image has been transferred and which is contacted by the heating roller 181, than the back side contacting the pressure roller 182. The moisture content becomes unbalanced in the paper α.

Further, the paper α is bent in complex curves when conveyed to the sheet-discharge rollers 192 from the heating roller 181 and the pressure roller 182. More specifically, the paper α is conveyed in a curved state between the transport rollers 183 and the sheet-discharge rollers 192.

Accordingly, when the paper α is discharged onto the sheet discharge tray 111, a tubular curl is likely produced in the paper α. That is, the widthwise (left and right) edges of the paper α curl inward.

If no replaceable adaptor 116 were mounted in the sheet discharge tray 111, a tubular curl will possibly be produced and the widthwise edges of the paper α discharged onto the sheet discharge tray 111 will curl upward away from the sheet discharge tray 111. As a result, sheets of the paper α already discharged onto the sheet discharge tray 111 will be pushed off the sheet discharge tray 111 by sheets subsequently discharged from the sheet-discharge rollers 192. Hence, the number of sheets of paper α that can be stacked on the sheet discharge tray 111 will be reduced by the added height produced from the curl.

Contrarily, according to the laser printer 101 of the present embodiment, the replaceable adaptor 116 is mounted in the sheet discharge tray 111. By preventing generation of tubular curl, the laser printer 101 allows more sheets of the paper α to be stacked on the sheet discharge tray 111 than does a conceivable laser printer 201, shown in FIG. 8(*b*), which is provided with the discharge tray 111 of the same depth with the laser printer 101 but is provided with no replaceable adaptor 116. As a result, the sheet discharge tray 111 of the laser printer 101 according to the present embodiment can be formed shallower than that of the conceivable laser printer 201, while allowing the same number of sheets of paper α to be stacked on the sheet discharge tray 111, thereby enabling construction of a smaller overall device.

Further, according to the present embodiment, paper is stacked on the curved stacking surface 117 such that the portion of paper on the rear surface part 117*a* is stacked at an angle upward forwardly from the horizontal, while the portion of paper on the front surface part 117*b* is horizontal or angled slightly downward forwardly from the horizontal (FIG. 7(*c*)). Accordingly, the paper α on the rear surface part 117*a* does not curl upward. The paper α on the rear surface part 117*a* will not block the discharge through-hole through which the sheet-discharge rollers 192 discharge the paper α. Tubular curl in the paper α is effectively suppressed by setting the angle within a range of 120° to 165° between the rear surface part 117*a* and the front surface part 117*b*. Tubular curl in the paper α is more effectively suppressed by setting the angle within a range of 130° to 150° between the rear surface part 117*a* and the front surface part 117*b*.

Tubular curl in the paper α is effectively suppressed by setting the length r of the replaceable adaptor 116 from the rear end 116*a* to the crest 116*c* approximately a half the length of the paper α in the paper discharging direction D. Tubular curl in the paper α is more effectively suppressed by setting the length r of the replaceable adaptor 116 in a range of 40-60% the length of the paper α in the paper discharging direction D (the longitudinal direction in this example). Tubular curl in the paper α is even more effectively suppressed by setting the length r of the replaceable adaptor 116 in another range of 45-55% the length of the paper α in the paper discharging direction D.

By forming both the front surface part 117*b* and the front part 110*b* of the top surface 110*a* at an angle in the range of −40° to +40° to the horizontal, it is possible to prevent the weight of the paper α from causing the paper α to move in the paper discharging direction D and causing the paper α to fall off the curved stacking surface 117 and the top surface 110*a*. With this construction, the paper α can be stacked on the curved stacking surface 117 without sliding off the downstream end (front end) of the curved stacking surface 117 and the top surface 110*a*.

By forming the rear surface part 117*a* to slant upward at an angle θ with respect to the horizontal within the range of 20° to 55°, by setting the length r from the rear end 116*a* to the crest 116*c* to approximately a half of the length of the paper α in the paper discharging direction D, and by setting the angle between the rear surface part 117*a* and the front surface part 117*b* within the range of 120° to 165°, it is ensured that the sheets of paper α stacked on the curved stacking surface 117 bend along the shape of the stacking surface 117 until at least 100 sheets of the paper α have been stacked thereon. Since the sheets of paper α bend along the shape of the stacking surface 117 up to at least 100 sheets, the sheets of paper α can be stacked on the curved stacking surface 117 with no shifting in the paper discharging direction D.

Since the trailing edge contact surface 112 is disposed perpendicular to the horizontal on the upstream end of the curved stacking surface 117, the trailing edge of the paper α contacts the trailing edge contact surface 112 when the paper α is stacked on the curved stacking surface 117.

Further, the width W of the stacking surface 117 in the direction orthogonal to the paper discharging direction D is larger than the paper width. Accordingly, even if the paper α shifts in the widthwise direction of the paper α, the paper α can still be stacked on the curved stacking surface 117 while conforming to the shape of the stacking surface 117.

By providing the replaceable adaptor 116 in the laser printer 101, heat from various devices provided within the main casing 110 is not likely to be transferred to the paper stacked on the replaceable adaptor 116. Hence, the laser printer 101 can effectively prevent the generation of tubular curl caused by heat.

It is noted that the demand for A4-size recording papers is the greatest, but recording papers with other sizes can still be used with the laser printer 101. It is therefore preferable to prepare a plurality of different replaceable adaptors 116 in correspondence with a plurality of different sizes of recording paper. When a user desires to print on papers with some size, the user mounts a corresponding replaceable adaptor 116 in the discharge tray 111. It is ensured that the papers will be stacked on the sheet discharge tray 111 without producing tubular curl.

An experiment was executed to confirm whether various shapes of the replaceable adaptor 116 can prevent the generation of tubular curl in the paper α.

As shown in FIG. 8(*a*), the shape of the replaceable adaptor 116 is determined by setting, as two parameters, the angle θ formed between the rear surface part 117*a* with respect to the horizontal, and the distance r from the rear edge 116*a* to the crest 116*c*. Various replaceable adaptors 116 were produced by varying the parameters θ and r. Each replaceable adaptor 116 was mounted on the sheet discharge tray 111, and papers were stacked on the top surface 117 of the replaceable adaptor 116. The conditions of papers stacked on the top surface 117 were observed. FIG. 9 is a graph showing the conditions of paper stacked on the curved stacking surface 117 of the replaceable adaptor 116 with various values for the distance r and the angle θ. The papers used in these experiments was DataCopy (trademark) manufactured by Modo and Recycling Copy (trademark) manufactured by Steinbeis, both of which were A4-size, 80 g/m$^2$ paper.

Figure 9:
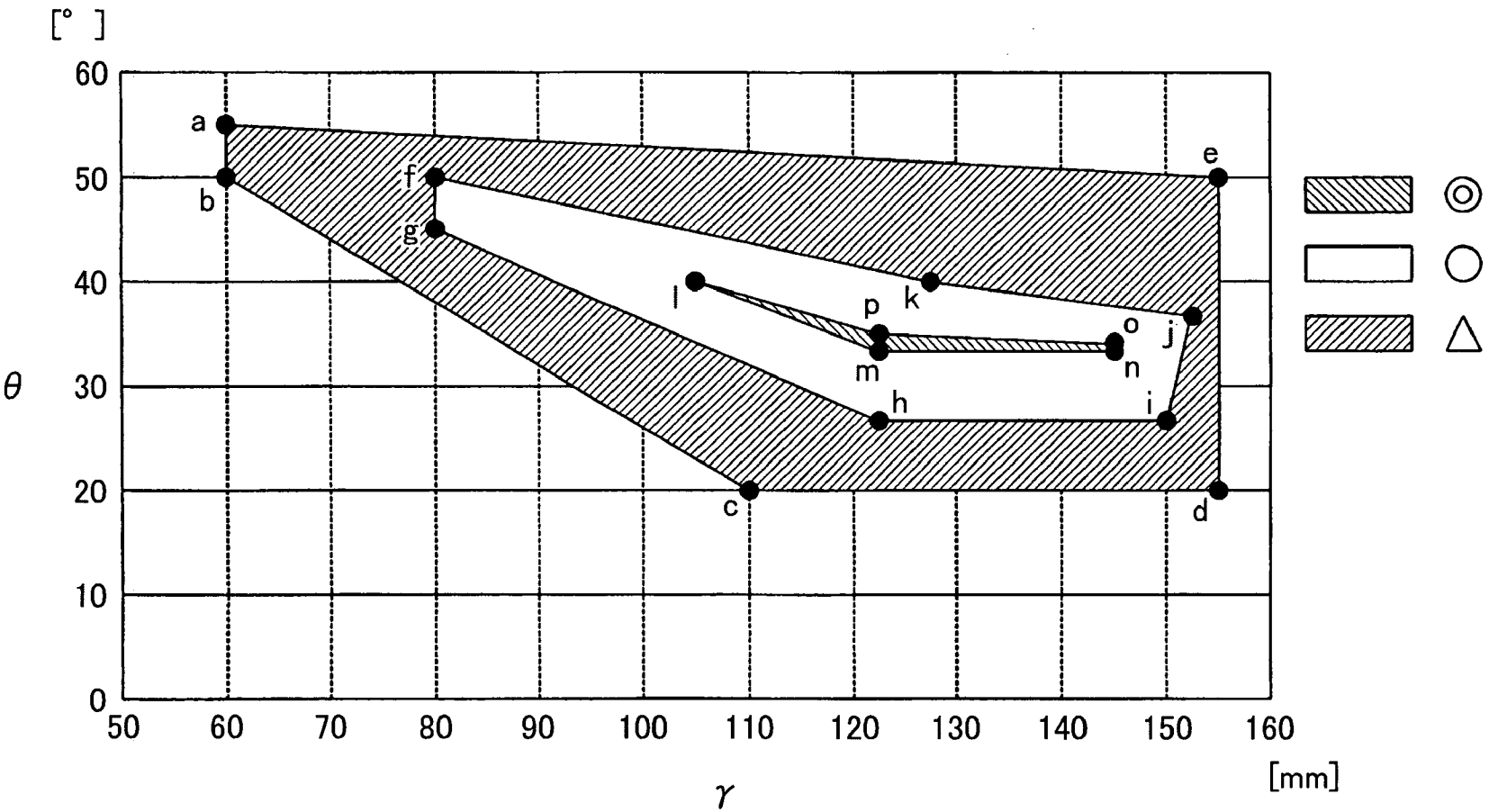
FIG. 9 is a graph showing the experimental results indicative of the conditions of papers stacked on the replacement adaptors with various parameters r and θ.

As shown in FIG. 9, some replaceable adaptors 116 that were designed with parameters that follow within the outermost line in the graph (the area enclosed by points a-e) produced a tubular curl, but still enabled a predetermined number of sheets of paper (predetermined full allowable capacity of paper) to be stacked on the sheet discharge tray 111.

Other replaceable adaptors 116 that were designed according to parameters within the middle range of the graph (enclosed by points f-k) produced a slight tubular curl, and enabled the predetermined number of sheets of paper (predetermined full allowable capacity of paper) to be stacked on the sheet discharge tray 111.

Other replaceable adaptors 116 that were designed according to parameters within the innermost range of the graph (enclosed by points l-p) generated no tubular curl, and enabled the predetermined number of sheets of paper (predetermined full allowable capacity of paper) to be stacked on the sheet discharge tray 111.

Other remaining replaceable adaptors 116 that were designed with parameters that fall outside the outermost range produced too much tubular curl and failed to receive the predetermined number of sheets of paper (predetermined full allowable capacity) on the sheet discharge tray 111.

By using the coordinate format (r, θ), the distance r and angle θ for each point can be expressed as a(60, 55), b(60, 50), c(110, 20), d(155, 20), e(155, 50), f(80, 50), g(80, 45), h(112, 27), i(150, 27), j(152, 37), k(130, 40), l(105, 40), m(122, 33), n(145, 33), o(145, 34), p(122, 35).

As is clear from FIG. 9, it is confirmed that the angle θ is preferably in a range of greater than or equal to 20° and smaller than or equal to 55° (a, c), more preferably in a range of greater than or equal to 27° and smaller than or equal to 50° (h, f), and most preferably in a range of greater than or equal to 33° and smaller than or equal to 40° (l, m).

The distance r is preferably in a range of greater than or equal to 60 mm (20%) and smaller than or equal to 155 (52%) mm (a, d), more preferably in a range of greater than or equal to 80 mm (27%) and smaller than or equal to 152 (51%) mm (f, j), and most preferably in a range of greater than or equal to 105 mm (35%) and smaller than or equal to 145 (49%) mm (l, n). The percentage values in the parenthesis indicate the percentage of the distance r relative to the longitudinal length of an A4-size sheet of paper (297 mm).

<First Modification>

Figure 10A:
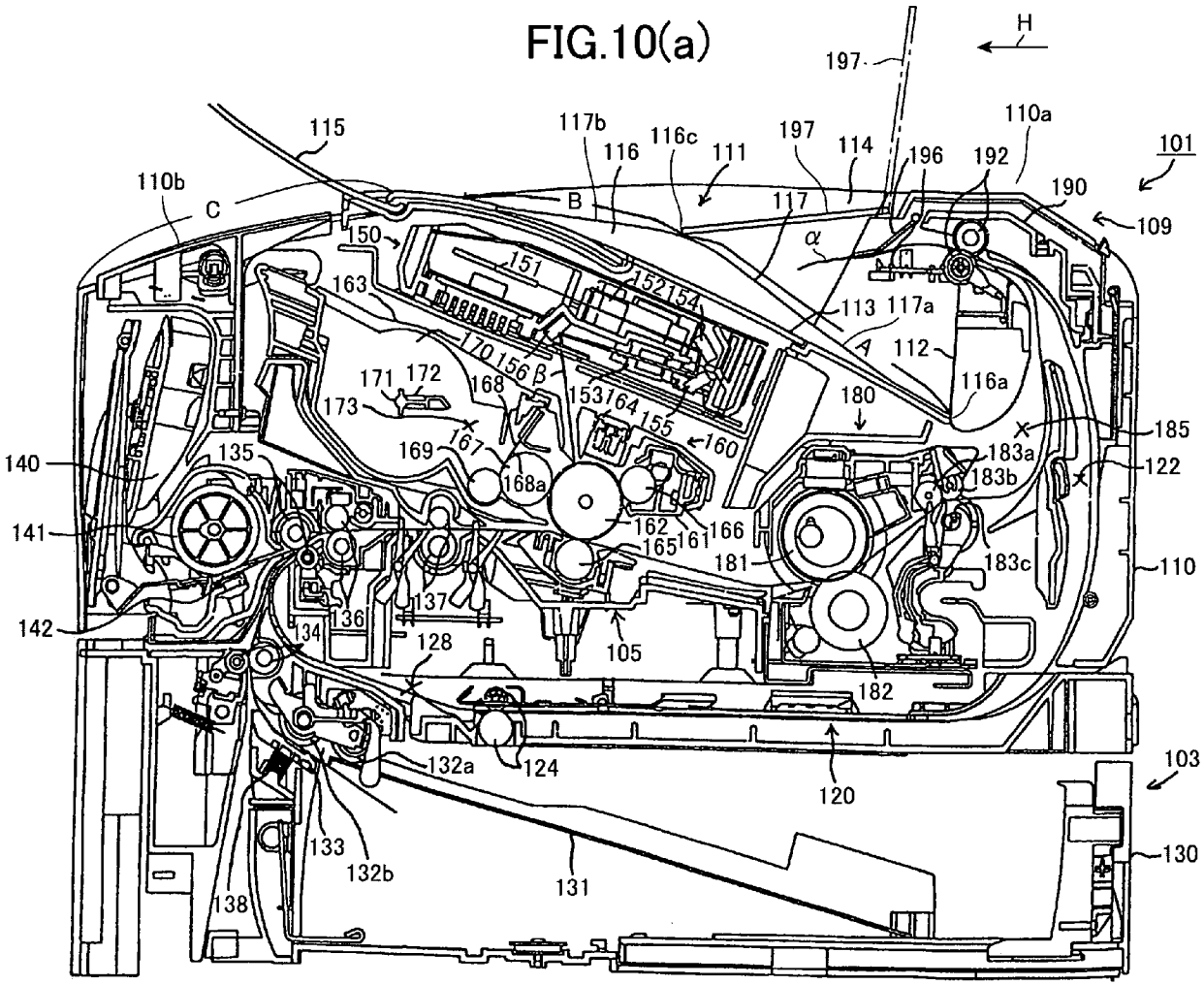
FIG. 10(*a*) is a side cross-sectional view of a laser printer according to a modification of the second embodiment.
Figure 10B:
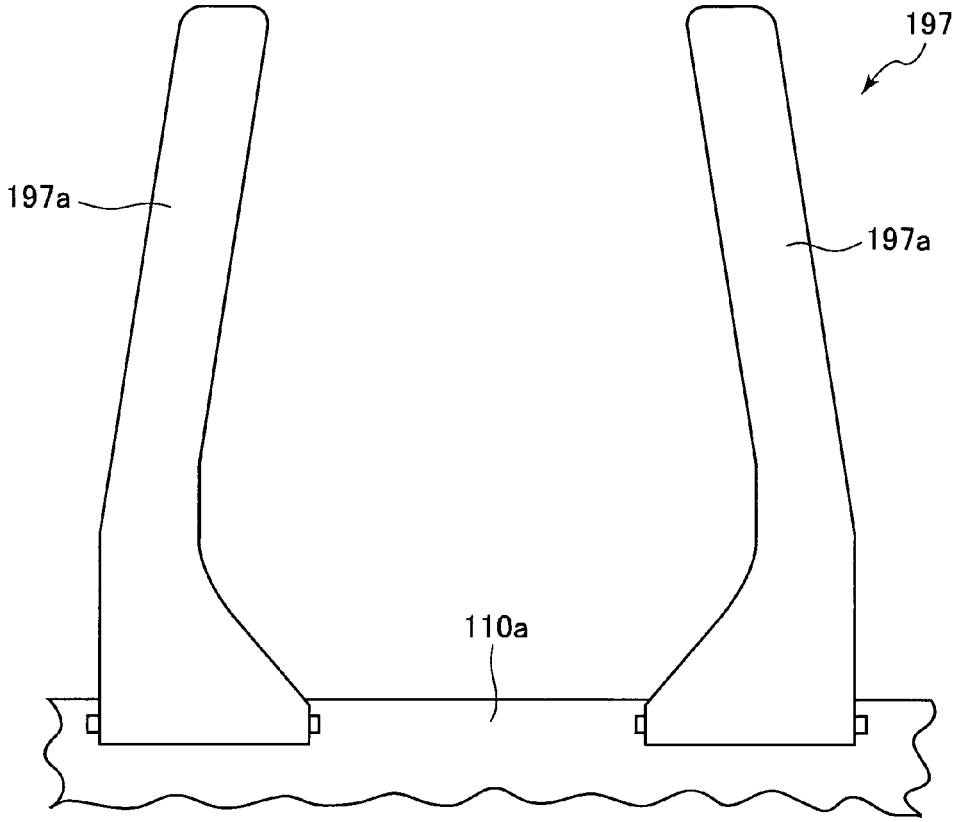

As shown in FIG. 10(*a*) and FIG. 10(*b*), a paper-holding member 197 may be provided at a location downstream of the sheet-discharge rollers 192 in the paper discharging direction D. As shown in FIG. 10(*b*), the paper-holding member 197 has a pair of plates 197*a* and 197*a*. The paper-holding member 197 is pivotably attached, via its one end, to the top surface 110*a* of the main casing 110. The paper-holding member 197 can switch between a closed state indicated by a solid line in FIG. 10(*a*) and an opened state indicated by a single dot chain line in FIG. 10(*a*). In the closed state, the free end of the paper-holding member 197 contacts the top surface 117 of the replaceable adaptor 116. When a stack of sheets of paper α is mounted on the top surface 117, the free end of the paper-holding member 197 contacts the upper surface of the uppermost sheet in the stack. Because the sheets of paper α stacked on the top surface 117 are held from above by the paper-holding member 197, the stack of the sheets of paper α is prevented from shifting on and falling off the top surface 117. By moving the paper-holding member 197 into the opened state, a user can pick up the sheets of paper α from the top surface 117.

<Second Modification>

Figure 11:
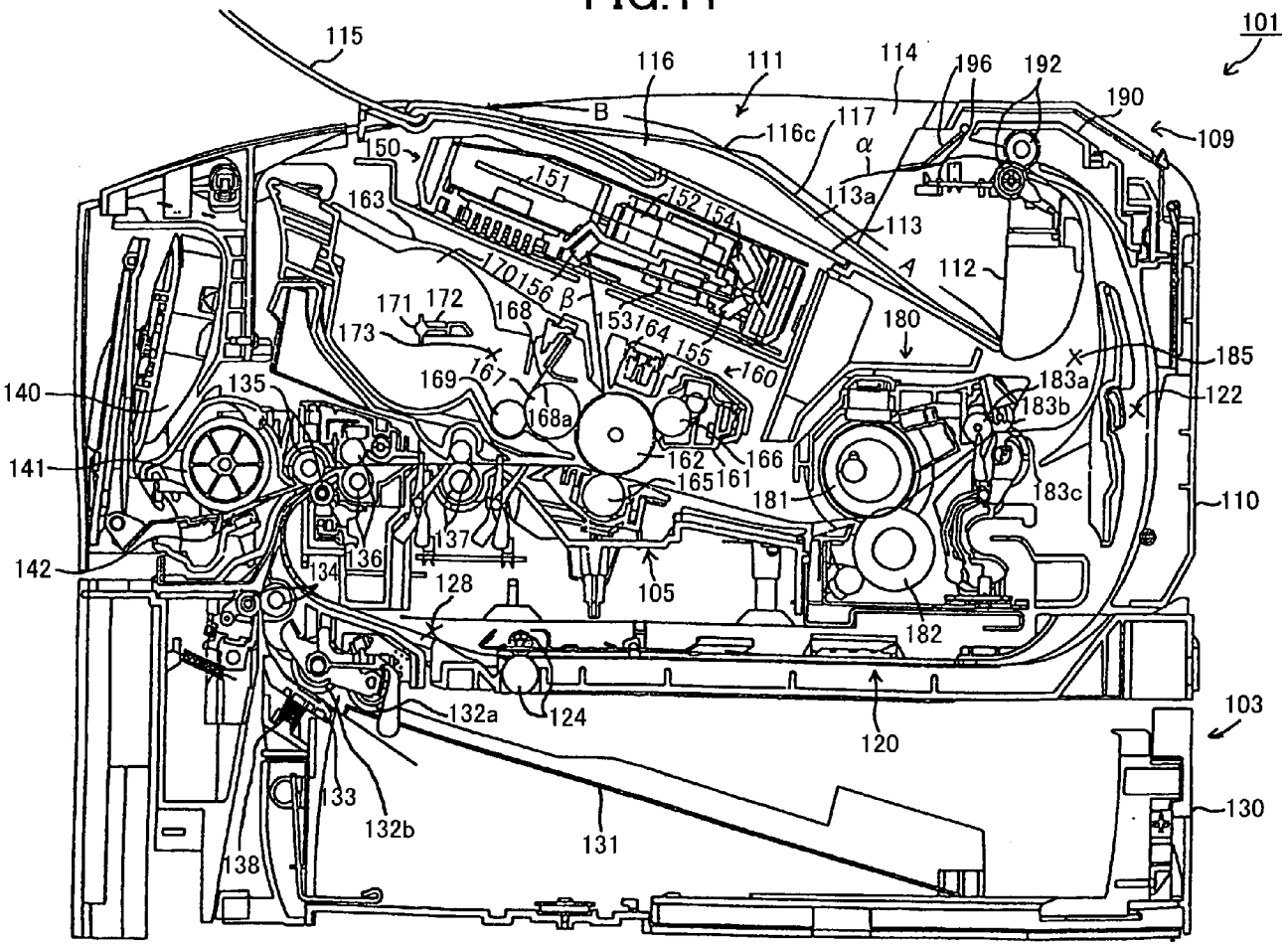
FIG. 11 is a side cross-sectional view of a laser printer according to another modification of the second embodiment.

As shown in FIG. 11, the replaceable adaptor 116 may not be used. Instead, the sheet discharge tray 111 may be modified to include not only the bottom wall 113 but also an additional bottom wall 113*a*. The additional bottom wall 113*a* protrudes upwardly away from the bottom wall 113 in the same shape as the top surface 117 of the replaceable adaptor 116.

It is preferable that a hollow space is formed between the bottom wall 113 and the additional bottom wall 113*a*. With this construction, heat from within the main casing 110 is not likely to transfer to the additional bottom wall 113*a* and, therefore, is not likely to transfer to the paper α, thereby effectively preventing the generation of tubular curl. It is even more preferable that the hollow space between the bottom wall 113 and the additional bottom wall 113*a* be evacuated.

<Third Modification>

Figure 12:
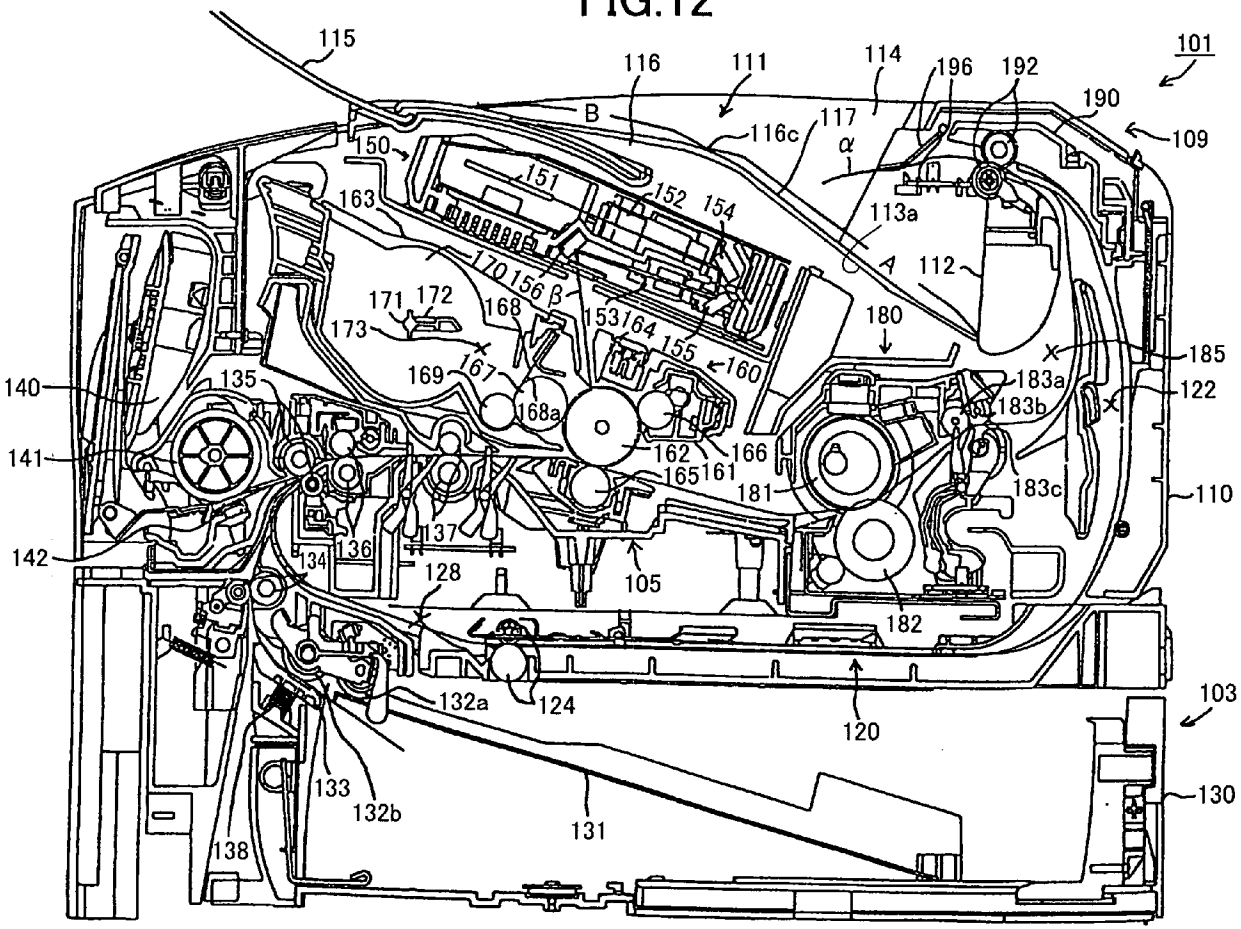
FIG. 12 is a side cross-sectional view of a laser printer according to another modification of the second embodiment.

According to the modification shown in FIG. 11, the laser printer 101 is provided with both the bottom wall 113 and the additional bottom wall 113*a*. However, the laser printer 101 may be provided with the additional bottom wall 113*a* only as shown in FIG. 12. In other words, the bottom wall 113 may be omitted from the laser printer 101.

<Fourth Modification>

Figure 13:
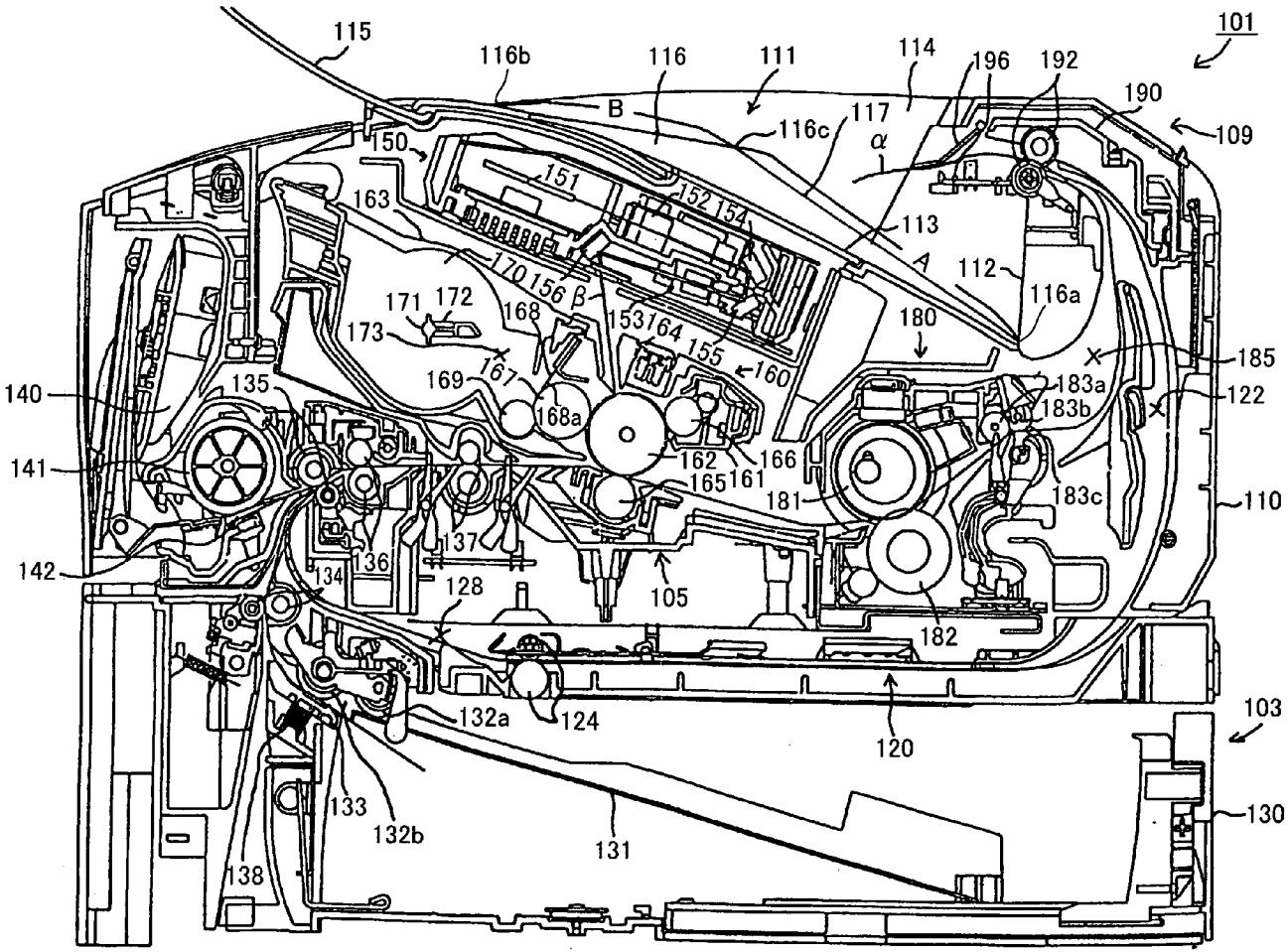
FIG. 13 is a side cross-sectional view showing a laser printer according to another modification of the second embodiment.

The replaceable adaptor 116 in the second embodiment is shaped such that the side cross-section of the top surface 117 extends in an approximate parabola curve. However, the side cross-section of the replaceable adaptor 116 may be formed in a triangular shape as shown in FIG. 13. That is, the side cross-section of the top surface 117 may extend in a straight line both between the rear end 116*a* and the crest 116*c* and between the crest 116*c* and the front end 116*b*.

In the second embodiment, the side cross-section of the top surface 117 from the rear end 116*a* through the crest 116*c* to the front end 116*b* is entirely curved in the approximate parabola curve. However, the side cross-section of the top surface 117 only at its area around the crest 116*c* may be curved in an approximate parabola curve, but other remaining regions of the top surface 117 may extend straightly.

While the invention has been described in detail with reference to the specific embodiments thereof, it would be apparent to those skilled in the art that various changes and modifications may be made therein without departing from the spirit of the invention.

For example, in the fixing section 180 of the second embodiment, similarly to the first embodiment, it is preferable that the angle of separation θ (°), the temperature $T_{HR}$ (° C.) of the surface of the heating roller 181, the diameter $D_{PR}$ (mm) of the pressure roller 182, and the width $W_{NIP}$ (mm) of the nip part 184 should satisfy the inequality of $114 \leqq 0.55\ T_{HR} - 2.36\theta - 1.59\ D_{PR} + 8.62\ W_{NIP} \leqq 144$. It is more preferable that the parameters θ (°), $T_{HR}$ (° C.), $D_{PR}$ (mm), and $W_{NIP}$ (mm) should satisfy the inequality of $119 \leqq 0.55\ T_{HR} - 2.36\theta - 1.59\ D_{PR} + 8.62\ W_{NIP} \leqq 134$. It is possible to more effectively prevent generation of the curl in the recording paper.

However, the parameters θ (°), $T_{HR}$ (° C.), $D_{PR}$ (mm), or $W_{NIP}$ (mm) may not satisfy the inequality of $114 \leqq 0.55\ T_{HR} - 2.36\theta - 1.59\ D_{PR} + 8.62\ W_{NIP} \leqq 144$. According to the function of the curved stacking surface 117, it is possible to prevent generation of tubular curl in the recording paper on the discharge tray 111.

While the above-described embodiments are directed to the laser printers, the embodiments may be applied to any other image-forming devices that are configured to fix a toner image on a recording paper with heat, such as a color laser printer or a toner jet printer.

What is claimed is:

1. An image-forming device comprising:

an image-forming portion that forms a visible image on an A4-size recording paper by using developer, the recording paper having four sides, the four sides including a pair of opposite first sides and a pair of opposite second sides that are longer than the first sides; and a fixing portion, the fixing portion including:

a heating roller having a central axis and a rigid peripheral surface around the central axis, the peripheral surface being heated to a temperature $T_{HR}$ (° C.); and a pressure roller having a central axis and a resilient layer around the central axis, the central axis of the pressure roller being parallel to the central axis of the heating roller, the pressure roller having a diameter $D_{PR}$ (mm), the pressure roller being pressed against the heating roller to allow the resilient layer to be compressed by the rigid surface of the heating roller, thereby causing the resilient layer of the pressure roller to deform and follow the shape of the surface of the heating roller, a nip part being defined as an area of contact between the heating roller and the pressure roller, the heating roller and the pressure roller rotating to convey the recording paper in a recording paper conveying direction through the nip part, the nip part having an upstream end and a downstream end in the recording paper conveying direction, the heating roller and the pressure roller conveying the recording paper through the nip part from the upstream end to the downstream end with a leading edge of the recording paper being one of the first sides, thereby causing the visible image to be fixed on the recording paper, the heating roller and the pressure roller discharging the recording paper fixed with the visible image from the downstream end of the nip part in a discharging direction, the heating roller having a width $W_{NIP}$ (mm) at the nip part between the upstream end and the downstream end, an angle of separation θ (°) being defined within a plane orthogonal to the central axis of the heating roller and being formed between the discharging direction and a tangent to the heating roller at the downstream end of the nip part, the temperature $T_{HR}$ (° C.), the angle of separation θ (°), the diameter $D_{PR}$ (mm), and the width $W_{NIP}$ (mm) satisfying the following inequality:

$$114 \leqq 0.55 T_{HR} - 2.36\theta - 1.59 D_{PR} + 8.62 W_{NIP} \leqq 144.$$

2. An image-forming device according to claim 1, wherein the control temperature $T_{HR}$ (° C.), the angle of separation θ (°), the diameter $D_{PR}$ (mm), and the width $M_{NIP}$ (mm) satisfy the following inequality:

$$119 \leqq 0.55 T_{HR} - 2.36\theta - 1.59 D_{PR} + 8.62 W_{NIP} \leqq 134.$$

3. An image-forming device according to claim 1, further comprising a controller that controls the temperature $T_{HR}$ of the heating roller to satisfy the inequality of $$114 \leqq 0.55 T_{HR} - 2.36\theta - 1.59 D_{PR} + 8.62 W_{NIP} \leqq 144.$$

4. An image-forming device according to claim 2, further comprising a controller that controls the temperature $T_{HR}$ of the heating roller to satisfy the inequality of $$119 \leqq 0.55 T_{HR} - 2.36\theta - 1.59 D_{PR} + 8.62 W_{NIP} \leqq 134.$$

5. An image-forming device comprising:

an image-forming portion that forms a visible image on an A4-size recording paper by using developer, the recording paper having four sides, the four sides including a pair of opposite first sides and a pair of opposite second sides that are longer than the first sides; and a fixing portion, the fixing portion including:

a heating roller having a central axis and a rigid peripheral surface around the central axis, the peripheral surface being heated to a temperature $T_{HR}$ (° C.) and a pressure roller having a central axis and a resilient layer around the central axis, the central axis of the pressure roller being parallel to the central axis of the heating roller, the pressure roller having a diameter $D_{PR}$ (mm), the pressure roller being pressed against the heating roller to allow the resilient layer to be compressed by the rigid surface of the heating roller, thereby causing the resilient layer of the pressure roller to deform and follow the shape of the surface of the heating roller, a nip part being defined as an area of contact between the heating roller and the pressure roller, the heating roller and the pressure roller rotating to convey the recording paper in a recording paper conveying direction through the nip part, the nip part having an upstream end and a downstream end in the recording paper conveying direction, the heating roller and the pressure roller conveying the recording paper through the nip part from the upstream end to the downstream end with a leading edge of the recording paper being one of the first sides, thereby causing the visible image to be fixed on the recording paper, the heating roller and the pressure roller discharging the recording paper fixed with the visible image from the downstream end of the nip part in a discharging direction, the heating roller having a width $W_{NIP}$ (mm) at the nip part between the upstream end and the downstream end, an angle of separation θ (°) being defined within a plane orthogonal to the central axis of the heating roller and being formed between the discharging direction and a tangent to the heating roller at the downstream end of the nip part, the temperature $T_{HR}$ (° C.), the angle of separation θ (°), the diameter $D_{PR}$ (mm), and the width $W_{NIP}$ (mm) satisfying the following inequality:

$$114 \leqq 0.55T_{HR} - 2.36\theta - 1.59D_{PR} + 8.62W_{NIP} \leqq 144,$$

wherein the image-forming portion forms the visible image by using toner, further comprising:

a controller that initially sets a target value that is higher than a softening point of the toner, and that controls the surface temperature of the heating roller to reach the target value; and a recording paper detecting unit that detects the recording paper that has passed through the nip part and that outputs a detection result, wherein while consecutively printing on sheets of the recording paper, the controller resets the target value to another value that is lower than the initially-set target value when the detection result indicates that a predetermined number of sheets of recording paper have passed through the nip part.

6. An image-forming device according to claim 5, wherein, after resetting the target value to the lower value, the controller further resets the present target value, which has already been reset, to still another value that is lower than the presently-set target value when the detection result indicates that another predetermined number of sheets of recording paper have passed through the nip part after the target value has been reset to the lower value.

7. An image-forming device according to claim 5, wherein the controller includes a timer that measures time;

wherein, after resetting the target value to the lower value, the controller resets the present target value, which has already been reset, to still another value that is lower than the presently-set value when a predetermined period of time has elapsed after the target value has been reset to the lower value.

8. An image-forming device comprising:

an image-forming portion that forms a visible image on an A4-size recording paper by using developer, the recording paper having four sides, the four sides including a pair of opposite first sides and a pair of opposite second sides that are longer than the first sides; and a fixing portion, the fixing portion including:

a heating roller having a central axis and a rigid peripheral surface around the central axis, the peripheral surface being heated to a temperature $T_{HR}$ (° C.) and a pressure roller having a central axis and a resilient layer around the central axis, the central axis of the pressure roller being parallel to the central axis of the heating roller, the pressure roller having a diameter $D_{PR}$ (mm), the pressure roller being pressed against the heating roller to allow the resilient layer to be compressed by the rigid surface of the heating roller, thereby causing the resilient layer of the pressure roller to deform and follow the shape of the surface of the heating roller, a nip part being defined as an area of contact between the heating roller and the pressure roller, the heating roller and the pressure roller rotating to convey the recording paper in a recording paper conveying direction through the nip part, the nip part having an upstream end and a downstream end in the recording paper conveying direction, the heating roller and the pressure roller conveying the recording paper through the nip part from the upstream end to the downstream end with a leading edge of the recording paper being one of the first sides, thereby causing the visible image to be fixed on the recording paper, the heating roller and the pressure roller discharging the recording paper fixed with the visible image from the downstream end of the nip part in a discharging direction, the heating roller having a width $W_{NIP}$ (mm) at the nip part between the upstream end and the downstream end, an angle of separation θ (°) being defined within a plane orthogonal to the central axis of the heating roller and being formed between the discharging direction and a tangent to the heating roller at the downstream end of the nip part, the temperature $T_{HR}$ (° C.). the angle of separation θ (°), the diameter $D_{PR}$ (mm), and the width $W_{NIP}$ (mm) satisfying the following inequality:

$$114 \leqq 0.55T_{HR} - 2.36\theta - 1.59D_{PR} + 8.62W_{NIP} \leqq 144,$$

wherein the image-forming portion forms the visible image by using toner, further comprising:

a controller that initially sets a target value that is higher than a softening point of the toner, and that controls the surface temperature of the heating roller to reach the target value, the controller including a timer that measures time, wherein while consecutively printing on sheets of the recording paper, the controller resets the target value to another value that is lower than the initially-set target value when a predetermined period of time has elapsed since the consecutive printing of the sheets of recording paper has been started being executed.

9. An image-forming device according to claim 8, wherein, after resetting the target value to the lower value, the controller resets the present target value, which has already been reset, to still another value that is lower than the presently-set value when another predetermined period of time has elapsed after the target value has been reset to the lower value.

10. An image-forming device according to claim 9, further comprising:

a casing having a top surface, the image-forming portion and the fixing portion being provided inside the casing;

a discharge roller that discharges, in a discharge-roller discharging direction, the recording paper, onto which the visible image has been fixed by the fixing portion; and a stacking portion having a stacking surface that faces upwardly and that receives thereon sheets of recording paper discharged by the discharge roller, the stacking surface having a first end that is positioned below the discharge roller and a second end that is downstream of the first end in the discharge-roller discharging direction, the stacking surface being connected to the top surface via the second end, the top surface extending in the discharge-roller discharging direction from the second end of the stacking surface, the stacking portion having a crest that protrudes upwardly at a position between the first end and the second end, the crest protruding substantially upwardly, a first part of the stacking surface defined between the first end and the crest being slanted upwardly toward the crest, an angle within a range of greater than or equal to 20 degrees and smaller than or equal to 55 degrees being formed between the first part and a horizontal direction.

11. An image-forming device comprising:

a casing having a top surface;

an image-forming portion that is provided inside the casing and that forms an image on a recording paper;

a discharge roller that discharges, in a discharge-roller discharging direction, the recording paper which has been formed with an image by the image-forming portion; and a stacking portion having a stacking surface that faces upwardly and that receives thereon sheets of recording paper discharged by the discharge roller, the stacking surface having a first end that is positioned below the discharge roller and a second end that is downstream of the first end in the discharge-roller discharging direction, the stacking surface being connected to the top surface via the second end, the top surface extending in the discharge-roller discharging direction from the second end of the stacking surface, the stacking portion having a crest that protrudes upwardly at a position between the first end and the second end, the crest protruding upwardly, a first part of the stacking surface defined between the first end and the crest being slanted upwardly toward the crest, an angle within a range of greater than or equal to 20 degrees and smaller than or equal to 55 degrees being formed between the first part and a horizontal direction.

12. An image-forming device according to claim 11, wherein an angle within a range of greater than or equal to 27 degrees and smaller than or equal to 50 degrees is formed between the first part and the horizontal direction.

13. An image-forming device according to claim 12, wherein an angle within a range of greater than or equal to 33 degrees and smaller than or equal to 40 degrees is formed between the first part and the horizontal direction.

14. An image-forming device according to claim 11, wherein a distance between the first end and the crest is approximately half the length of the recording paper with respect to the discharge-roller discharging direction.

15. An image-forming device according to claim 14, wherein the distance between the first end and the crest is within a range of 40 to 60% of the length of the recording paper with respect to the discharge-roller discharging direction.

16. An image-forming device according to claim 15, wherein the distance between the first end and the crest is within a range of 45 to 55% of the length of the recording paper with respect to the discharge-roller discharging direction.

17. An image-forming device according to claim 11, wherein the stacking surface has an area sufficiently large to receive an A4-size recording paper thereon.

18. An image-forming device according to claim 11, wherein each of a second part of the stacking surface defined between the second end and the crest and the top surface of the casing forms an angle in a range of greater than or equal to −40 degrees and smaller than or equal to +40 degrees with respect to the horizontal direction, thereby preventing the recording paper stacked on the stacking surface from moving by its own weight in the discharge-roller discharging direction and from falling off the top surface.

19. An image-forming device according to claim 11, wherein the first part and the second part of the stacking surface form therebetween an angle within a range of greater than or equal to 120 degrees and smaller than or equal to 165 degrees.

20. An image-forming device according to claim 19, wherein the first part and the second part of the stacking surface form therebetween an angle within a range of greater than or equal to 130 degrees and smaller than or equal to 150 degrees.

21. An image-forming device according to claim 11, wherein the first part and the second part of the stacking surface form therebetween an angle within a range of greater than or equal to 120 degrees and smaller than or equal to 165 degrees, thereby allowing the recording paper to bend along the shape of the stacking surface and allowing one hundred sheets of paper to be stacked on the stacking surface.

22. An image-forming device according to claim 11, further comprising a trailing edge contact surface that extends vertically and that is connected to the stacking surface at the first end.

23. An image-forming device according to claim 11, further comprising a paper-holding portion that contacts an upper surface of the sheet of recording paper that is stacked on the stacking surface and that is located at a position downstream of the discharge roller in the discharge-roller discharging direction.

24. An image-forming device according to claim 11, wherein the stacking surface has a width, in a direction orthogonal to the discharge-roller discharging direction, larger than a size of the recording paper defined in the direction orthogonal to the discharge-roller discharging direction.

25. An image-forming device according to claim 11, further comprising a casing wall that faces upwardly, wherein the stacking portion has a mount surface facing downwardly, the stacking portion being mounted on the casing wall with the mount surface confronting the casing wall.

26. An image-forming device according to claim 25, wherein the stacking portion is detachably mounted on the casing wall.

* * * * *